US012078398B2

(12) United States Patent
Welch et al.

(10) Patent No.: US 12,078,398 B2
(45) Date of Patent: Sep. 3, 2024

(54) REFRIGERANT CHARGE MONITORING SYSTEMS AND METHODS FOR MULTIPLE EVAPORATORS

(71) Applicant: Copeland LP, Sidney, OH (US)

(72) Inventors: Andrew Welch, Franklin, OH (US); Nathan O. Boyce, Vandalia, OH (US)

(73) Assignee: Copeland LP, Sidney, OH (US)

( * ) Notice: Subject to any disclaimer, the term of this patent is extended or adjusted under 35 U.S.C. 154(b) by 36 days.

(21) Appl. No.: 17/494,274

(22) Filed: Oct. 5, 2021

(65) Prior Publication Data

US 2023/0109334 A1 Apr. 6, 2023

(51) Int. Cl.
*F25B 49/02* (2006.01)
*F25B 5/02* (2006.01)

(52) U.S. Cl.
CPC ..... *F25B 49/02* (2013.01); *F25B 5/02* (2013.01); *F25B 2500/222* (2013.01); *F25B 2700/04* (2013.01)

(58) Field of Classification Search
CPC ..... F25B 49/02; F25B 5/02; F25B 2500/222; F25B 2700/04
See application file for complete search history.

(56) References Cited

U.S. PATENT DOCUMENTS 5,077,982 A * 1/1992 Shaffer, Jr. ..... F24F 3/065 62/174
11,131,471 B1 9/2021 Butler et al.
2012/0318011 A1* 12/2012 Ochiai ..... F25B 49/005 62/127
2018/0038621 A1 2/2018 Toyoshima
2020/0200457 A1 6/2020 Sata et al.

FOREIGN PATENT DOCUMENTS

WO WO-2008035418 A1 3/2008
WO WO-2021049191 A1 3/2021

OTHER PUBLICATIONS

International Search Report regarding Application No. PCT/US2022/045786 dated Jan. 31, 2023.
Written Opinion of the ISA regarding Application No. PCT/US2022/045786 dated Jan. 31, 2023.

* cited by examiner

*Primary Examiner* — Nael N Babaa
(74) *Attorney, Agent, or Firm* — Harness, Dickey & Pierce, P.L.C.

(57) ABSTRACT

A condenser charge module is configured to: determine a first amount of refrigerant in each condenser of one or more condensers of a refrigeration system; determine a total condenser amount of refrigerant based on the one or more first amounts. An evaporator charge module is configured to: determine a second amount of refrigerant in each evaporator of two or more evaporators of the refrigeration system; and determine a total evaporator amount of refrigerant based on the two or more second amounts. A line charge module is configured to: determine a third amount of refrigerant in each refrigerant line of multiple refrigerant lines of the refrigeration system; and determine a total line amount of refrigerant based on the multiple third amounts. A total module is configured to determine a total amount of refrigerant in the refrigeration system based on the total condenser, the total evaporator, and the total line amounts.

20 Claims, 19 Drawing Sheets

REFRIGERANT CHARGE MONITORING SYSTEMS AND METHODS FOR MULTIPLE EVAPORATORS

FIELD

The present disclosure relates to refrigeration systems and more particularly to systems and methods for managing refrigerant within a refrigeration system.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Refrigeration and air conditioning applications are under increased regulatory pressure to reduce the global warming potential of the refrigerants they use. In order to use lower global warming potential refrigerants, the flammability of the refrigerants may increase.

Several refrigerants have been developed that are considered low global warming potential options, and they have an ASHRAE (American Society of Heating, Refrigerating and Air-Conditioning Engineers) classification as A2L, meaning mildly flammable. The UL (Underwriters Laboratory) 60335-2-40 standard, and similar standards, specifies a predetermined (M1) level for A2L refrigerants and indicates that A2L refrigerant charge levels below the predetermined level do not require leak detection and mitigation.

SUMMARY

In a feature, a refrigerant monitoring system includes: a condenser charge module configured to: determine a first amount of refrigerant in each condenser of one or more condensers of a refrigeration system; determine a total condenser amount of refrigerant based on the one or more first amounts; an evaporator charge module configured to: determine a second amount of refrigerant in each evaporator of two or more evaporators of the refrigeration system; and determine a total evaporator amount of refrigerant based on the two or more second amounts; a line charge module configured to: determine a third amount of refrigerant in each refrigerant line of multiple refrigerant lines of the refrigeration system; and determine a total line amount of refrigerant based on the multiple third amounts; and a total module configured to determine a total amount of refrigerant in the refrigeration system based on the total condenser amount, the total evaporator amount, and the total line amount.

In further features, the condenser charge module is configured to determine the first amount of refrigerant in one of the one or more condensers based on: a fourth amount of vapor refrigerant in the one of the one or more condensers; a fifth amount of two-phase refrigerant in the one of the one or more condensers; and a sixth amount of liquid refrigerant in the one of the one or more condensers.

In further features, the condenser charge module is configured to determine the first amount of refrigerant in the one of the one or more condensers based on the fourth amount plus the fifth amount plus the sixth amount.

In further features, the condenser charge module is configured to set the total condenser amount based on a sum of the one or more first amounts.

In further features, the evaporator charge module is configured to determine the second amount of refrigerant in one of the two or more evaporators based on: a seventh amount of vapor refrigerant in the one of the two or more evaporators; and an eighth amount of two-phase refrigerant in the one of the two or more evaporators.

In further features, the evaporator charge module is configured to determine the first amount of refrigerant in the one of the one or more evaporators based on the seventh amount plus the eighth amount.

In further features, the evaporator charge module is configured to: determine the seventh amount of vapor refrigerant in the one of the two or more evaporators based on a first enthalpy of the vapor refrigerant; and determine the eighth amount of two-phase refrigerant in the one of the two or more evaporators based on a second enthalpy of the two-phase refrigerant.

In further features, the evaporator charge module is configured to: determine a difference between the first and second enthalpies; determine a first percentage of a total volume of the one of the two or more evaporators including vapor refrigerant based on the difference between the first and second enthalpies; determine a second percentage of the total volume of the one of the two or more evaporators including vapor refrigerant based on the difference between the first and second enthalpies; determine the seventh amount based on the first percentage, a first density of vapor refrigerant, and the total volume; and determine the eighth amount based on the first percentage, a second density of two-phase refrigerant, and the total volume.

In further features, the evaporator charge module is configured to set the total evaporator amount based on a sum of the two or more second amounts.

In further features, the line charge module is configured to set the total line amount based on a sum of the multiple third amounts.

In further features: a leak module is configured to selectively diagnose that a leak is present in the refrigeration system based on the total amount of refrigerant; and at least one module configured to take at least one remedial action in response to the diagnosis that the leak is present in the refrigeration system.

In further features, the at least one module includes: an isolation module configured to, in response to the diagnosis that the leak is present in the refrigeration system of a building, close a first isolation valve located between a condenser located outside of the building and an evaporator located within the building; and a compressor module configured to, in response to the diagnosis that the leak is present in the refrigeration system, operate a compressor of the refrigeration system for a predetermined period.

In further features, the isolation module is further configured to, in response to a determination that compressor has operated for the predetermined period while the first isolation valve is closed, close a second isolation valve located between the evaporator and the compressor of the refrigeration system.

In further features, the first and second isolation valves are located outside of the building.

In further features, the at least one module configured to take at least one remedial action includes an alert module configured to, in response to the diagnosis that the leak is present in the refrigeration system, generate an alert via a visual indicator.

In further features, the at least one module configured to take at least one remedial action includes an alert module configured to, in response to the diagnosis that the leak is present in the refrigeration system, transmit an alert to an external device via a network.

In further features, the leak module is configured to diagnose that a leak is present in the refrigeration system when the total amount of refrigerant is less than a predetermined amount.

In further features, the leak module is configured to diagnose that a leak is present in the refrigeration system when a decrease in the total amount of refrigerant over a predetermined period is greater than a predetermined amount.

In further features, the evaporator charge module is configured to maintain the second amount of refrigerant in an evaporator constant in response to a determination that refrigerant flow through the evaporator is disabled.

In a feature, a refrigerant monitoring method for a refrigeration system includes: by one or more processors, determining a first amount of refrigerant in each condenser of one or more condensers of a refrigeration system; by the one or more processors, determining a total condenser amount of refrigerant based on the one or more first amounts; by the one or more processors, determining a second amount of refrigerant in each evaporator of two or more evaporators of the refrigeration system; by the one or more processors, determining a total evaporator amount of refrigerant based on the two or more second amounts; by the one or more processors, determining a third amount of refrigerant in each refrigerant line of multiple refrigerant lines of the refrigeration system; by the one or more processors, determining a total line amount of refrigerant based on the multiple third amounts; and by the one or more processors, determining a total amount of refrigerant in the refrigeration system based on the total condenser amount, the total evaporator amount, and the total line amount.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1C:
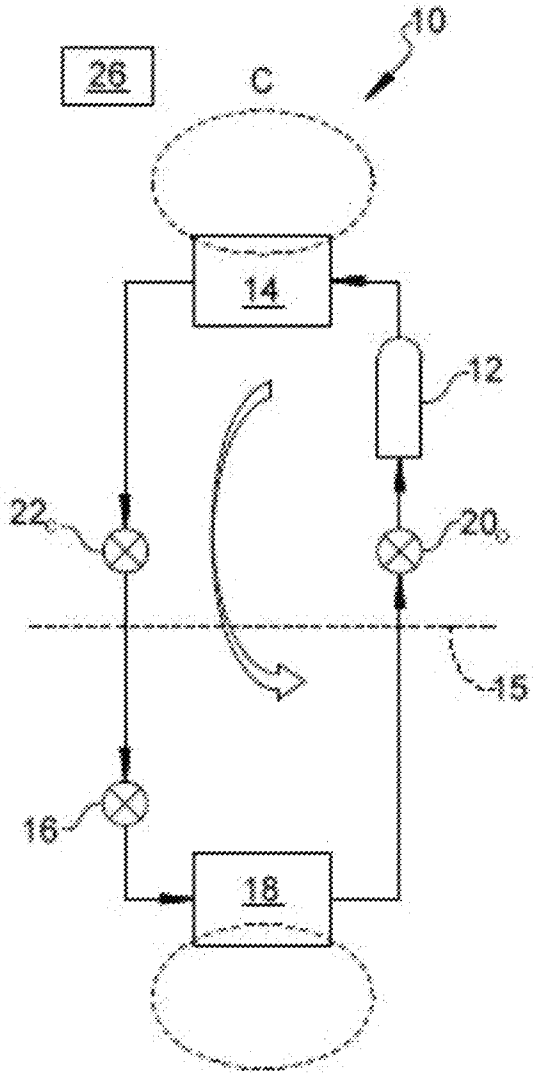
FIGS. 1A-1C are schematic views of a residential split air conditioning system.

Example embodiments will now be described more fully with reference to the accompanying drawings. Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1B:
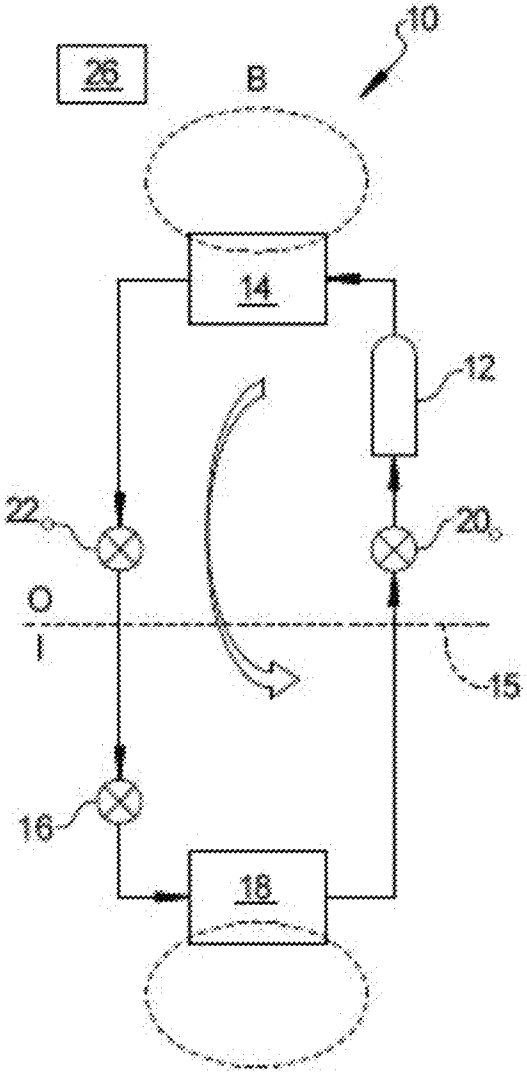
Figure 1A:
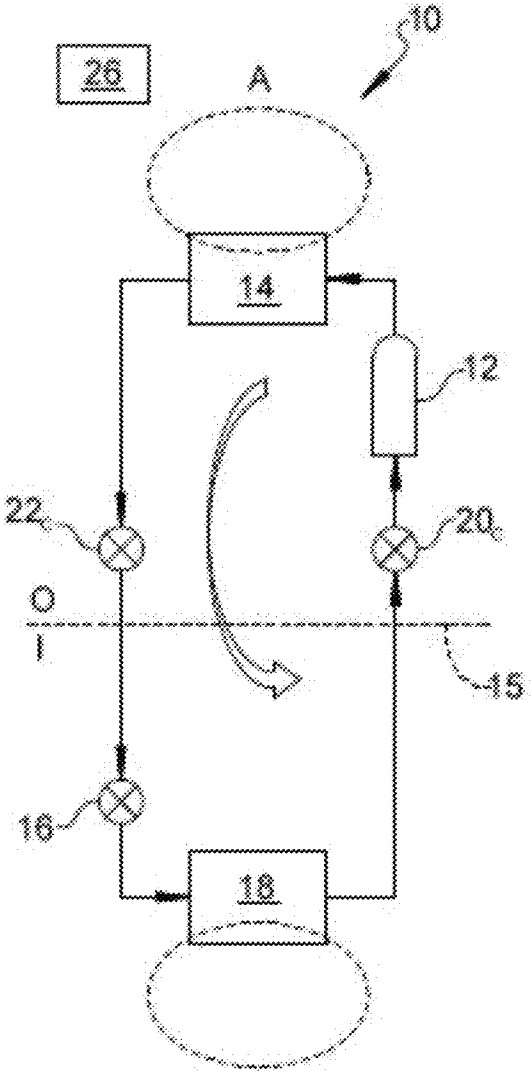

With reference to FIGS. 1A-C, a split air conditioning (AC) system 10 is shown including a compressor 12 and a condenser 14 disposed outside of a building 15 (i.e., outside) that is cooled using the AC system 10. The AC system 10 includes an expansion valve 16 and an evaporator 18 disposed inside the building 15 (i.e., indoors) that is cooled using the AC system 10.

A first isolation valve 20 is disposed outside of the building 15 and between the evaporator 18 and the compressor 12. A second isolation valve 22 is disposed outside of the building 15 and between the condenser 14 and the expansion valve 16. Refrigerant lines are connected between the components of the AC system 10. For example, a refrigerant line is connected between the compressor 12 and the condenser 14, a refrigerant line is connected between the condenser 14 and the second isolation valve 22, a refrigerant line is connected between the second isolation valve 22 and the expansion valve 16, a refrigerant line is connected between the expansion valve 18 and the evaporator 18, a refrigerant line is connected between the evaporator 18 and the first isolation valve 20, and a refrigerant line is connected between the first isolation valve 20 and the compressor 12.

In FIG. 1A, the AC system 10 is shown in an "OFF" condition with the compressor 12 OFF and the first and second isolation valves $\mathbf{20}_c$, $\mathbf{22}_c$ CLOSED. FIG. 1B shows the AC system 10 in a normal operating mode with the compressor "ON" and the first and second isolation valves $\mathbf{20}_o$, $\mathbf{22}_o$ OPEN. At shutdown, as shown in FIG. 1C, a control module (discussed further below) may close the second isolation valve $\mathbf{22}_c$, maintain the first isolation valve $\mathbf{20}_o$ open, and maintain the compressor 12 on for a predetermined period. This may pump down (remove/pump out) refrigerant from within the indoor section of the AC system 10 and trap the refrigerant within the outdoor section of the air conditioning system 10. After the predetermined period has expired, the control module may close the first isolation valve $\mathbf{20}_o$ and turn the compressor 12 off, as shown in FIG. 1A. This may isolate the indoor section I of the AC system 10 from the outdoor section O. The effect of the pump out of refrigerant from the indoor section I to the outdoor section O reduces an amount (e.g., a mass or a weight) of refrigerant within in the indoor section I to less than a predetermined amount a minimal level preferably below the M1 charge level for the A2L refrigerant.

The isolation valves 20, 22 may be positive sealing and controlled by a control module. The control module also controls operation (e.g., on or off) and may control speed of the compressor 12. The control module selectively controls the isolation valves 20, 22 according to an operational state and requirements to selectively divide the AC system 10 including the piping (refrigerant lines) and components of the system into zones. In various implementations, the isolation valve 20 can be integrated with the compressor 12, for example, as a discharge check valve or a suction check valve. The isolation valves 20, 22 can be sealing ball valves, solenoid valves, electronic expansion valves, check valves, needle valves, butterfly valves, globe valves, vertical slide valves, choke valves, knife valves, pinch valves, plug valves, gate valves, diaphragm valves, or another suitable type of actuated valve.

During the pump out operation, refrigerant is moved at the end of a compressor operational cycle to the isolated outdoor zones of the system. This lowers the amount of refrigerant that is within the building 15 that could possibly leak within the building 15 when the compressor is non-operational.

The control module can communicate with the compressor 12, one or more fans, the isolation valves 20, 22, and various sensors wirelessly or by wire and do so directly or indirectly. The control module can include one or more modules and can be implemented as part of a control board, furnace board, thermostat, air handler board, contactor, or other form of control system or diagnostic system. The control module can contain power conditioning circuitry to supply power to various components using 24 Volts (V) alternating current (AC), 120V to 240V AC, 5V direct current (DC) power, etc. The control module can include bidirectional communication which can be wired, wireless, or both whereby system debugging, programming, updating, monitoring, parameter value/state transmission etc. can occur. AC systems can more generally be referred to as refrigeration systems.

Figure 2:
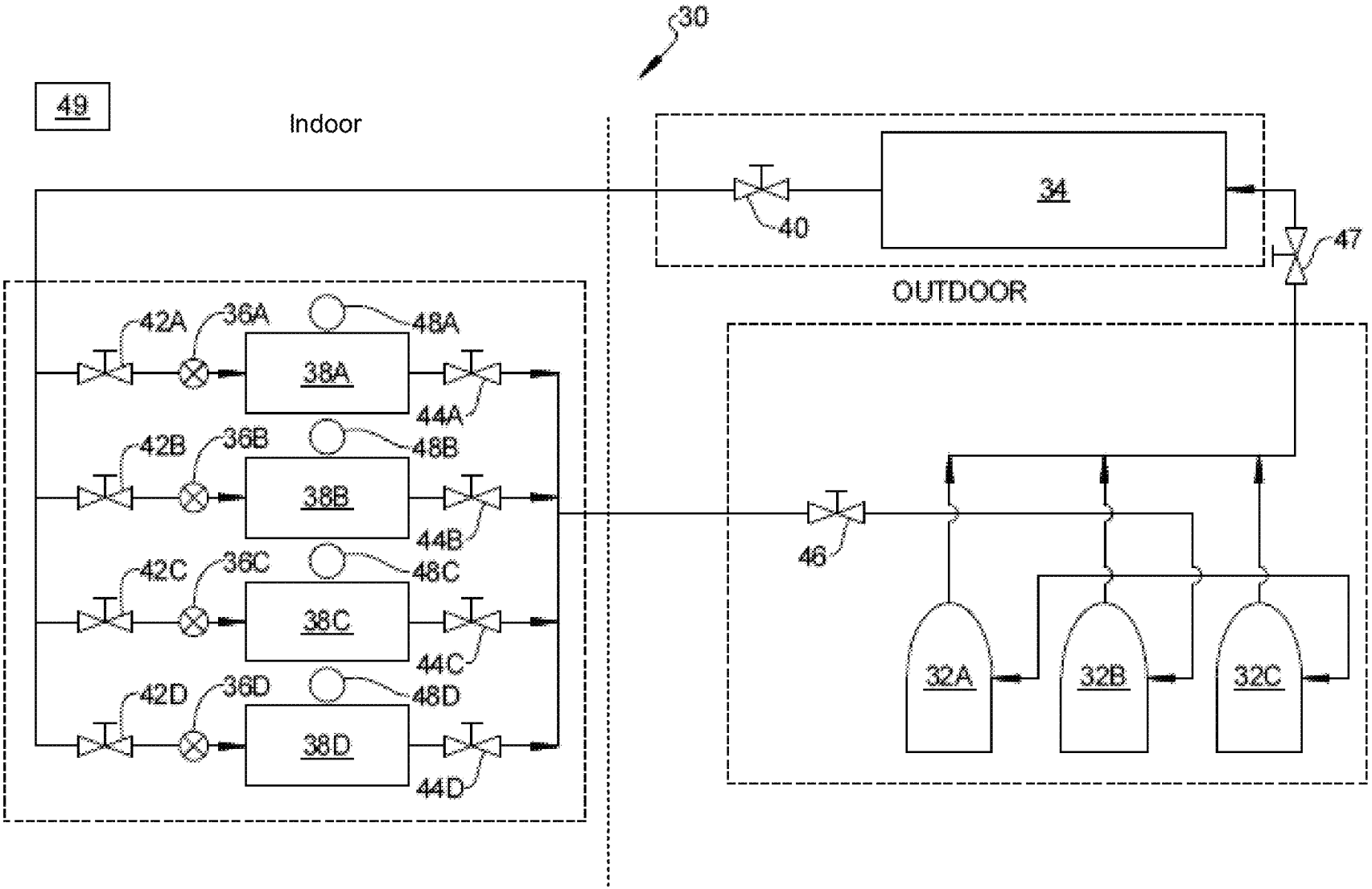
FIG. 2 is a schematic view of a rack refrigeration system.

With reference to FIG. 2 a rack refrigeration system 30 of a building 35 (e.g., a commercial building, such as a supermarket) is shown including a plurality of compressors 32A-C and a condenser 34 disposed outdoors or in a ventilated indoor room in the building 35. A plurality of electronic expansion valves or thermal expansion valves 36A-D (hereinafter "expansion valves 36A-D") and a plurality of evaporators 38A-D are located inside of the building 35 (i.e., inside of or in an indoor side I the building 35).

A first isolation valve 40 is disposed on the outdoor side O of the building 35 (i.e., outdoors) and between the condenser 34 and the plurality of evaporators 38A-D. A plurality of second isolation valves 42A-D may be disposed between the condenser 34 and the expansion valves 36A-D within the indoor section I of the refrigeration system 30. If electronic expansion valves 36A-D are used and are capable of properly sealing, the plurality of second isolation valves 42A-D may be omitted and the expansion valves 36A-D may be used as the isolation valves 42A-D.

A plurality of third isolation valves 44A-D are disposed between the plurality of evaporators 38A-D, respectively, and the compressors 32A-C, such as within the indoor section I. A fourth isolation valve 46 can be disposed outside of the building 35 and upstream of the plurality of compressors 32A-C. While the example of three compressors is provided, a greater or lesser number of compressors may be used. A fifth isolation valve 47 can be disposed between the plurality of compressors 32 and the condenser 34. While the example of one condenser 34 is provided, multiple condensers may be connected in parallel.

A plurality of leak sensors 48A-D can be placed in proximity to each of the plurality of evaporators 38A-D, such as at a midpoint of the evaporators 38A-D, respectively. The evaporators 38A-D may be disposed at the lowest point of the refrigeration system 30 (i.e., lower than the other components of the refrigeration system 30). Because the A2L refrigerant may be heavier than air, the placement of the leak sensors 48A-D in proximity to the evaporators 38A-D may increase a likelihood of detecting the presence of a leak the indoor section I.

The leak sensors 48A-D can be, for example, an infrared leak sensor, an optical leak sensor, a chemical leak sensor, a thermal conductivity leak sensor, an acoustic leak sensor, an ultrasonic leak sensor, or another suitable type of leak sensor. A control module 49 is provided in communication with the isolation valves, compressors 32A-C, and leak sensors 48A-D. If a leak is detected at one of the plurality of evaporators 38A-D, the control module 49 may close the associated isolation valves 42A-D, 44A-D, or electronic expansion valves 36A-D of that one of the evaporators 38A-D. This may isolate the one of the evaporators 38A-D that has the leak so that the remaining evaporators 38A-D of the refrigeration system can continue to function without disruption while preventing the refrigerant from escaping from the refrigeration system.

The control module 49 may close the additional isolation valves 40, 46 to isolate the indoor refrigeration section from the outdoor refrigeration section, such as when the refrigeration system is off or during maintenance.

The plurality of compressors 32A-C can be provided with an oil separator and a liquid receiver can be provided downstream of the condenser 34. Each of the evaporators 38A-D can be associated with a predetermined low temperature (e.g., for frozen food) or a predetermined medium temperature (e.g., refrigerated food) refrigeration compartment.

Figure 3:
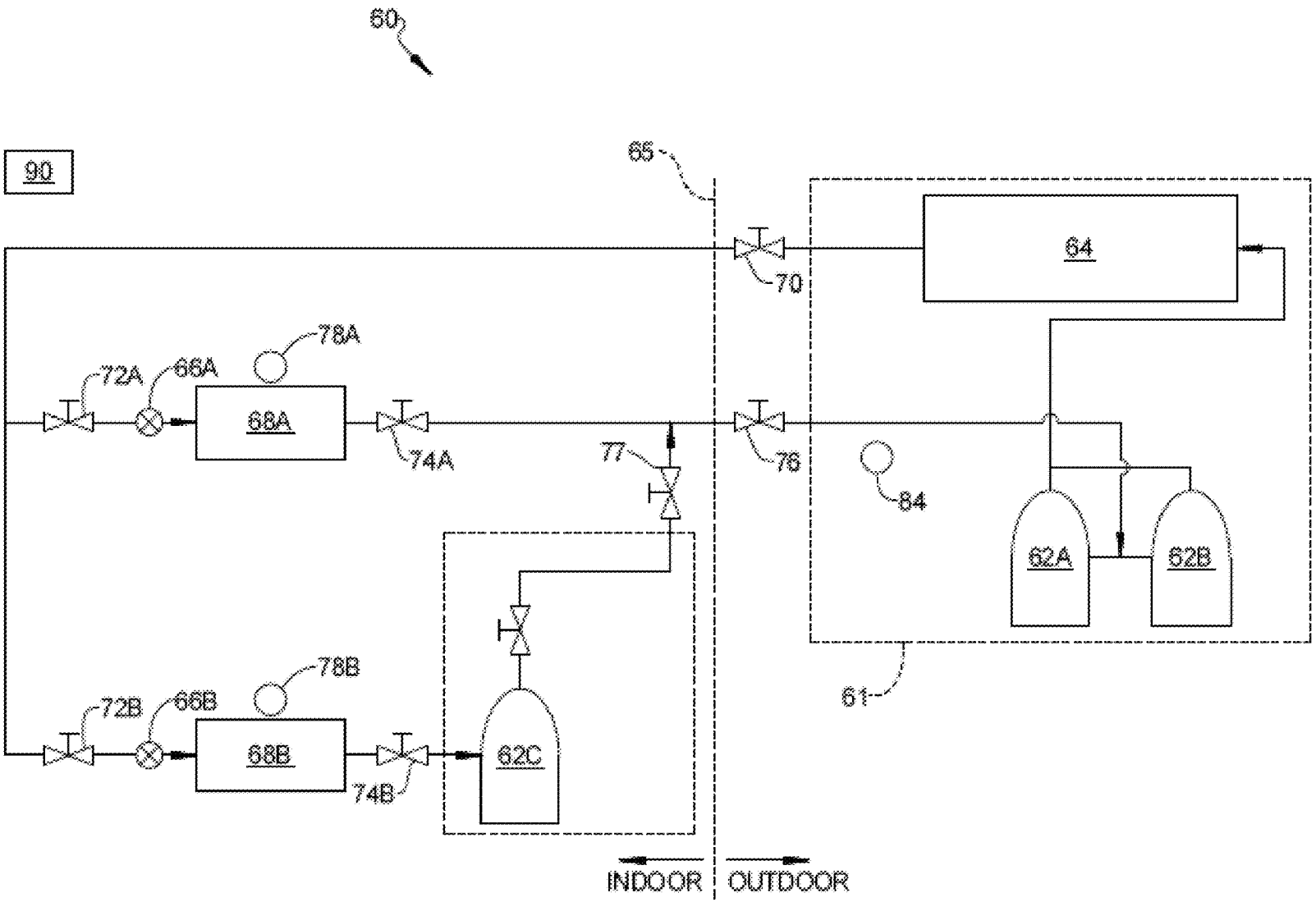
FIG. 3 is a schematic view of a microbooster refrigeration system.

With reference to FIG. 3 a refrigeration system 60 (e.g., a microbooster refrigeration system) is shown including an (e.g., medium temperature) condensing unit 61 including a plurality of outdoor compressors 62A-B and a condenser 64 disposed outside of a building 65 (e.g., a supermarket or another type of commercial building). A plurality of expansion valves 66A-B and a plurality of evaporators 68A-B are disposed inside of the building 65 (i.e., indoors).

An additional compressor unit 62C may be included inside the building 65 in connection with the evaporator 68B. The evaporator 68B may be associated with a low temperature (frozen food) refrigeration compartment, while the evaporator 68A may be associated with a higher (e.g., medium) temperature (e.g., refrigerated food) refrigeration compartment.

A first isolation valve 70 is disposed (e.g., in the outdoor side O of the building 65) between the condenser 64 and the plurality of evaporators 68A-B. A plurality of second isolation valves 72A-B may be disposed between the condenser 64 and the expansion valves 66A-B, such as within the indoor section I of the refrigeration system 60. If electronic expansion valves 66A-B implemented and configured to seal, the plurality of second isolation valves 72A-B may be omitted and the electronic expansion valves 66A—may serve the as isolation valves.

A plurality of third isolation valves 74A-B are disposed downstream of the plurality of evaporators 78A-B and between the evaporators 78A-B, respectively, and the compressors 62A-B. A fourth isolation valve 76 can be implemented up stream of the plurality of compressors 62A-B, such as inside or outside of the building 65. A fifth isolation valve 77 can be disposed between the low temperature compressor(s) 62C and the compressors 62A-B.

A plurality of leak sensors 78A-B can be disposed near the plurality of evaporators 68A-B, respectively. The evaporators 68A-B may be disposed at a lowest point of the refrigeration system 60. Because the A2L refrigerant may be heavier than air, the placement of the leak sensors 78A-B in proximity to the evaporators 68A-B may increase a likelihood of detection of the presence of leaked A2L refrigerant within the indoor environment I.

The leak sensors 78A-B may be infrared leak sensors, optical leak sensors, chemical leak sensors, thermal conductivity leak sensors, acoustic leak sensors, ultrasonic leak sensors, or another suitable type of leak sensor. If a leak is detected at one of the plurality of evaporators 68A-B, a control module may close the associated isolation valves 72A-B, 74A-B or electronic expansion valves 66A-B to isolate the one of the evaporators 68A-B that is determined to be leaking. This may allow the remaining evaporator(s) to continue to function without disruption.

The plurality of outdoor compressors 62A-B can be included with an oil separator, and a liquid receiver can be included downstream of the condenser 64. The evaporator 68A can be associated with a (e.g., medium temperature) refrigeration compartment. The evaporator 68B can be associated with a (e.g., low temperature) refrigeration compartment.

A control module 90 communicates with the isolation valves, compressors, and leak sensors. The control module 90 may control the isolation valves 70, 76, such as to isolate the indoor section I from the outdoor section O of the refrigeration system 60. The isolation valve 74B may be omitted since the isolation valve 77 is downstream of the compressors 62C.

The control module 90 may control the isolation valves 76 and 77 to minimize leak potential depending on the amount of refrigerant trapped in each of the indoor and outdoor sections. An additional outdoor leak sensor 84 may be included, such as to detect refrigerant leakage from the condensing unit 61.

Figure 5A:
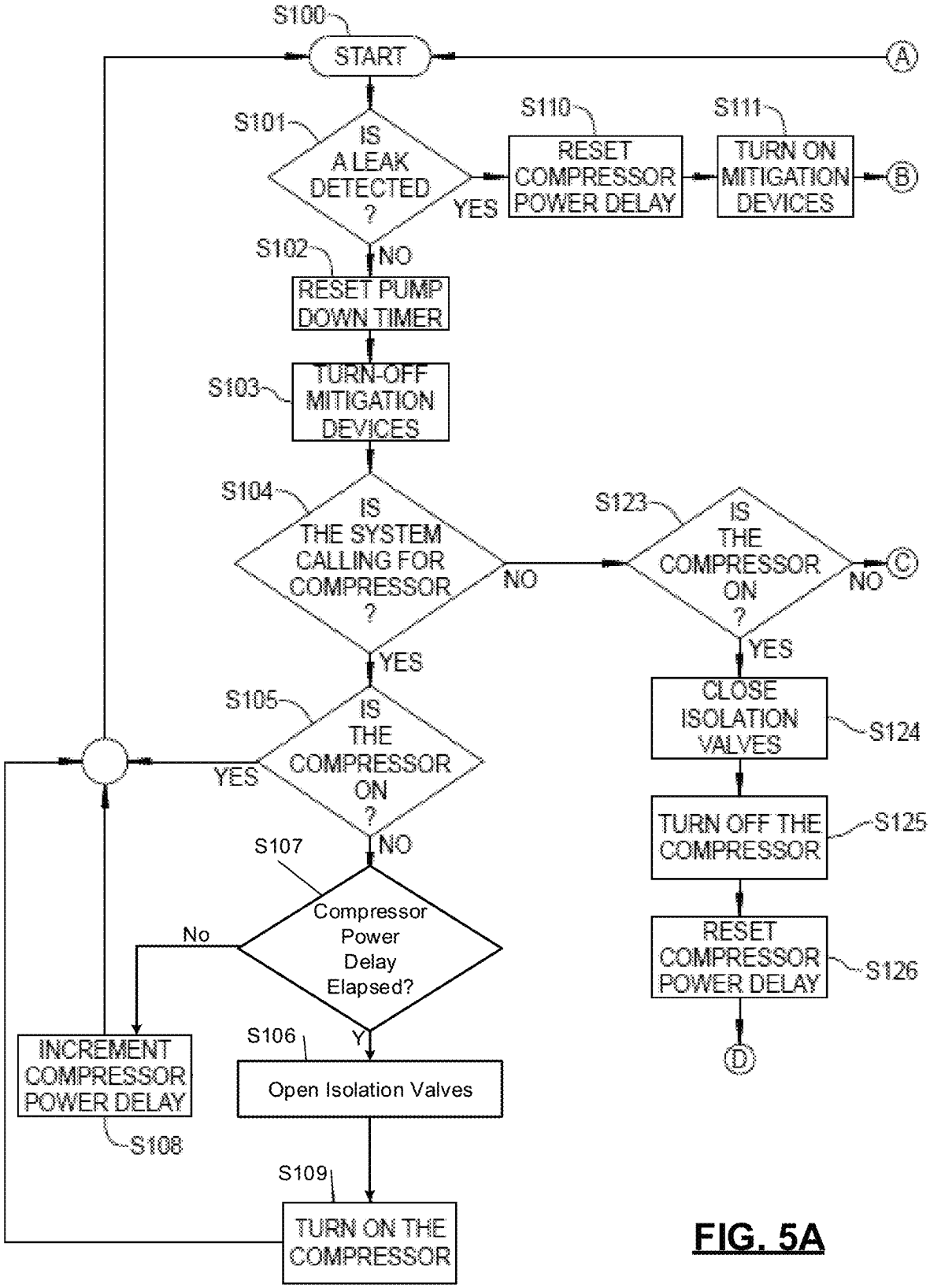
FIGS. 5A-5B are a flowchart depicting an example method of controlling isolation valves and a compressor of a refrigeration or HVAC system.
Figure 5B:
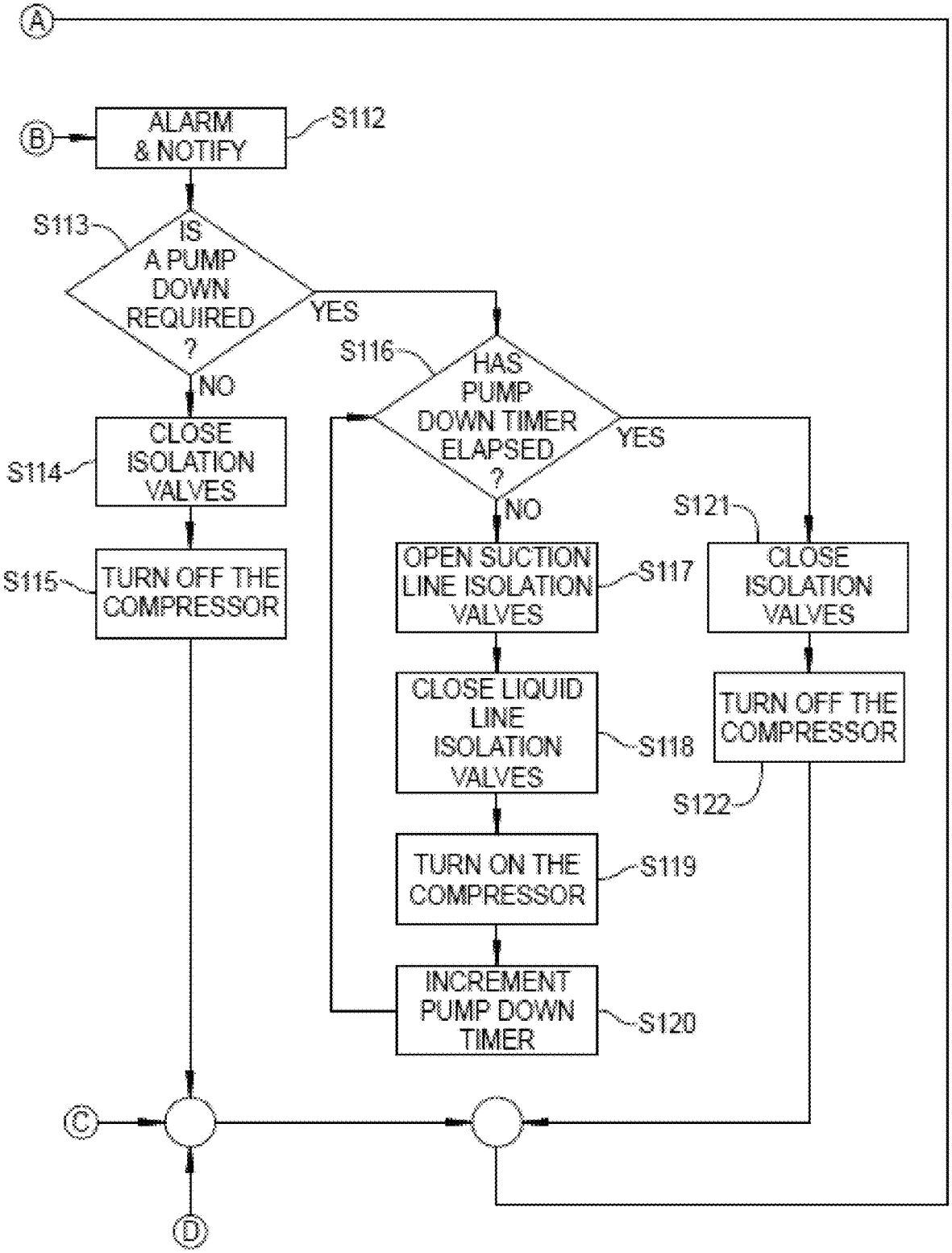

FIGS. 5A-5B are a flowchart depicting an example method of controlling the isolation valve(s) and compressor operation. Control discussed herein may be executed by a control module or one or more submodules of a control module.

At S100, control begins and proceeds with S101 where control determines whether a leak is detected. As discussed herein, a control module may detect a leak based on input from one or more leak sensors, pressure sensors, and/or temperature sensors. For example, a control module may calculate an amount of refrigerant within the system and determine that a leak is present when the amount of refrigerant decreases by at least than a predetermined amount. Other ways to determine whether a leak is present are discussed herein.

If no leak is detected at S101, control continues with S102 where the control module resets a pump down timer. The algorithm proceeds to S103 where the control module turns off mitigation devices. For example, the control module may turn off an indoor fan/blower within the building, such as a blower that blows air across the evaporator(s) if a cooling request is not present/active. While the example of the fan/blower is provided, one or more other devices configured to mitigate a leak may additionally or alternatively be turned off. If a leak is detected at S101, control transfers to 110, which is discussed further below.

At S104, the control module determines whether a call for compressor operation has been received, such as from a thermostat of the building. If S104 is true, control continues with S105. If S104 is false, control transfers to S123, which is discussed further below.

At S105, the control module determines whether the compressor is ON. If the compressor is ON at S105, control returns to S100. If the compressor is OFF at S104, control continues with S106. At S107, the control module determines whether a predetermined compressor power delay period has elapsed since the compressor was last turned OFF. The control module may determine that the predetermined compressor power delay period has elapsed when a compressor power delay counter is greater than a predetermined value (corresponding to the predetermined compressor delay period). While the example of a counter is provided, a timer may be used and the period of the timer may be compared with the predetermined compressor power delay period. If the predetermined compressor power delay has not elapsed at S107, the control module increments (e.g., by 1) the compressor power delay counter at S108, and control returns to S101. If the predetermined compressor power delay has elapsed at S107, at S106, the control module opens one, more than one, or all of the isolation valves. The control module turns on the compressor at S109, and control returns to S100.

As discussed above, if a leak is detected at S101, control continues with S110. At S110, the control module resets the compressor power delay counter (e.g., to zero). While the example of incrementing the counter and resetting the counter to zero are provided, the control module may alternatively decrement the counter (e.g., by 1), reset the counter to the predetermined value, and compare the counter value to zero. At S111, the control module turns the mitigation device(s) ON. For example, the control module may turn on the fan/blower within the building. Control continues with S112 (FIG. 5B).

At S112, the control module generates one or more indicators that a leak is present. For example, the control module may activate a visual indicator (e.g., one or more lights or another type of light emitting device), display a message on a display, etc. The display may be, for example, a display of or on the control module or another device (e.g., the thermostat). Additionally or alternatively, the control module may output an audible indicator via one or more speakers.

At S113, the control module determines whether to pump down (pump out) the refrigeration system. A predetermined pump down requirement (e.g., a predetermined pump down period) can be set, for example, based on a predetermined volume of the refrigeration system within the building and set at installation and is greater than zero. Alternatively, the predetermined pump down requirement can be determined by the control module, for example, based on an indoor charge calculation as discussed herein. If at S113 it is determined that no pump down is required, control continues with S114 where the control module closes the isolation valves. The control module turns off the compressor at S115, and control returns to S100.

If the control module determines to pump down the refrigeration system at S113, control continues with S116. At S116, the control module determines whether a predetermined pump down period has elapsed since the determination was made to pump down the refrigeration system. The control module may determine that the predetermined pump down period has elapsed when a pump down timer is greater than the predetermined pump down period. While the example of a timer is provided, a counter may be used and the counter value may be compared with a predetermined value corresponding to the predetermined pump down period. If the predetermined compressor pump down period has not elapsed at S116, control continues with S117. If the predetermined pump down period has elapsed at S116, control transfers to S121, which is discussed further below.

At S117, the control module opens (or maintains open) one or more isolation valves implemented in suction lines (e.g., 20 of FIGS. 1A-1C, 44A-C and/or 46 in FIG. 2, etc.). Isolation valves implemented in suction lines are located between an output of one or more evaporators and input of one or more compressors. At S118, the control module closes (or maintains closed) one or more isolation valves implemented in liquid lines (e.g., 22 of FIGS. 1A-1C, 42A-D and/or 40 of FIG. 2, etc.). Isolation valves implemented in liquid lines are located between an output of one or more compressors and an input of one or more evaporators. At S119, the control module turns on the compressor(s). The compressor(s) then draw refrigerant out of the indoor section of the refrigeration system and trap the refrigerant in the outdoor section of the refrigeration system, outside of the building. The control module increments the pump down timer at S120, and control returns to S116.

At S121, when the predetermined pump down period has elapsed, the control module closes the isolation valves (e.g., including those implemented in suction lines). At S122, the control module turns the compressor(s) off. Control returns to S100.

Returning to S104 if the control module determines that a call for operation of the compressor has not been received, control continues with S123. At S123, the control module determines whether the compressor is ON. If S123 is true, control continues with S124. At S124, the control module closes or maintains closed (e.g., all of) the isolation valves. At S125, the control module turns off or maintains off the compressor(s). At S126, the control module resets the compressor delay counter (e.g., to zero), and control returns to S100.

With the pump down operation, the refrigerant inside a potentially occupied space (indoors, within the building) is minimized during compressor non-operational time by use of a compressor pump down along with closure of the liquid side isolation valve(s) before the compressor shut down and closure of the vapor line isolation valve(s) when the compressor(s) is shutdown. The decision process may include an evaluation of early leak indicators to prevent larger leaks or the frequency of operation to indicate the potential for a long off period.

Figure 6:
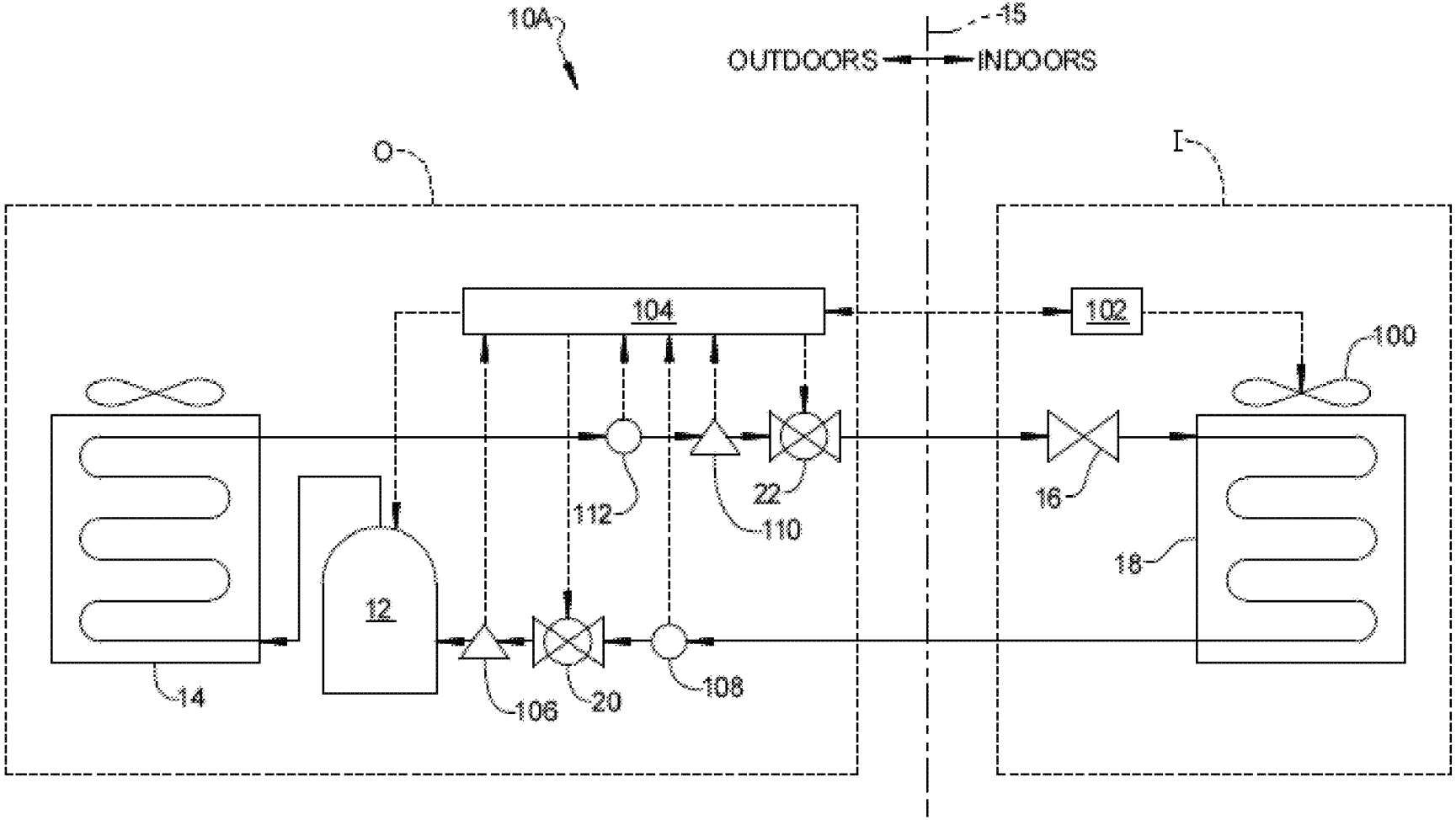
FIG. 6 is a functional block diagram of an example air conditioning system including isolation valves, pressure sensors, and temperature sensors.

With reference to FIG. 6 functional block diagram of an example refrigeration system 10A (e.g., an air conditioning system) is provided. Isolation valves and pressure and temperature sensors are included in FIG. 6.

The system 10A is shown including a compressor 12 and a condenser 14 disposed outside of a building 15 (i.e., outdoors). An expansion valve 16 and an evaporator 18 are disposed inside of the building 15 (i.e., indoors).

A first isolation valve 20 is disposed, for example, outside of the building 15 and is disposed (in a suction line) between the evaporator 18 and the compressor 12. A second isolation valve 22 is disposed, for example, outside of the building 15, and is disposed (in a liquid line) between the condenser 14 and the expansion valve 16.

A fan or blower 100 (a mitigation device) is provided adjacent to the evaporator 18 and is controlled by a first control module 102. A second control module 104 calculates indoor and outdoor refrigerant charge amounts based on measurements from a first temperature sensor 106 and a first pressure sensor 108 disposed between the evaporator 18 and the compressor 12 and a second temperature sensor 110 and a second pressure sensor 112 disposed between the condenser 14 and the expansion valve 16. The indoor and outdoor charge amounts may be calculated while the HVAC system is ON and, more specifically, when the compressor 12 is on. The indoor and outdoor refrigerant charge amounts are amounts (e.g., masses or weights) of the refrigerant within the indoor and outdoor sections of the refrigeration system, respectively. The second control module 104 may calculate the indoor charge amount, for example, using one or more equations or lookup tables that relate the measurements from the temperature and pressure sensors to indoor charge amounts. The second control module 104 may calculate the outdoor charge amount, for example, using one or more equations or lookup tables that relate the measurements from the temperature and pressure sensors to outdoor charge amounts.

The second control module 104 may determine an overall (or total) refrigerant charge amount based on the indoor and outdoor refrigerant charge amounts. The second control module 104 may calculate the overall charge amount, for example, using one or more equations or lookup tables that relate indoor and outdoor charge amounts to overall charge amounts. For example, the second control module 104 may set the overall charge amount based on or equal to the indoor charge amount plus the outdoor charge amount.

If the overall charge amount decreases from a predetermined (e.g., initial amount) of refrigerant by at least a predetermined amount, the second control module 104 may determine that a leak is present. The second control module 104 may determine that no leaks are present when the overall charge amount has not decreased by at least the predetermined amount. The predetermined amount may be calibrated and may be greater than zero.

If a leak is detected, the second control module 104 performs a pump out routine. The second control module 104 closes the second isolation valve 22, opens the first isolation valve 20, and turns the compressor 12 on to pump down refrigerant from the indoor side I to the outdoor side O of the system 10. The second control module 104 later closes the first isolation valve 20 and turns off the compressor to isolate the outdoor section O of the system from the indoor section I of the system, for example, when the predetermined pump down period has elapsed. The second control module 104 prompts the first control module 102 to turn ON the fan 100 when a leak is detected. The second control module 104 may also prompt the first control module 102 or itself turn on one or more other mitigation devices when a leak is detected. This may help dissipate or reduce any leaked refrigerant.

The second control module 104 may determine whether a leak is present, for example, by detecting a pressure decrease in at least one of the outdoor section and the indoor section of the refrigeration system. When the isolation valves 20, 22, the compressor 12, or the expansion device 16 is/are used to control the refrigerant charge within the indoor section inside of a potentially occupied space the control module 104 may activate the fan 100 to dilute a refrigerant leak when a leak is detected.

Figure 4:
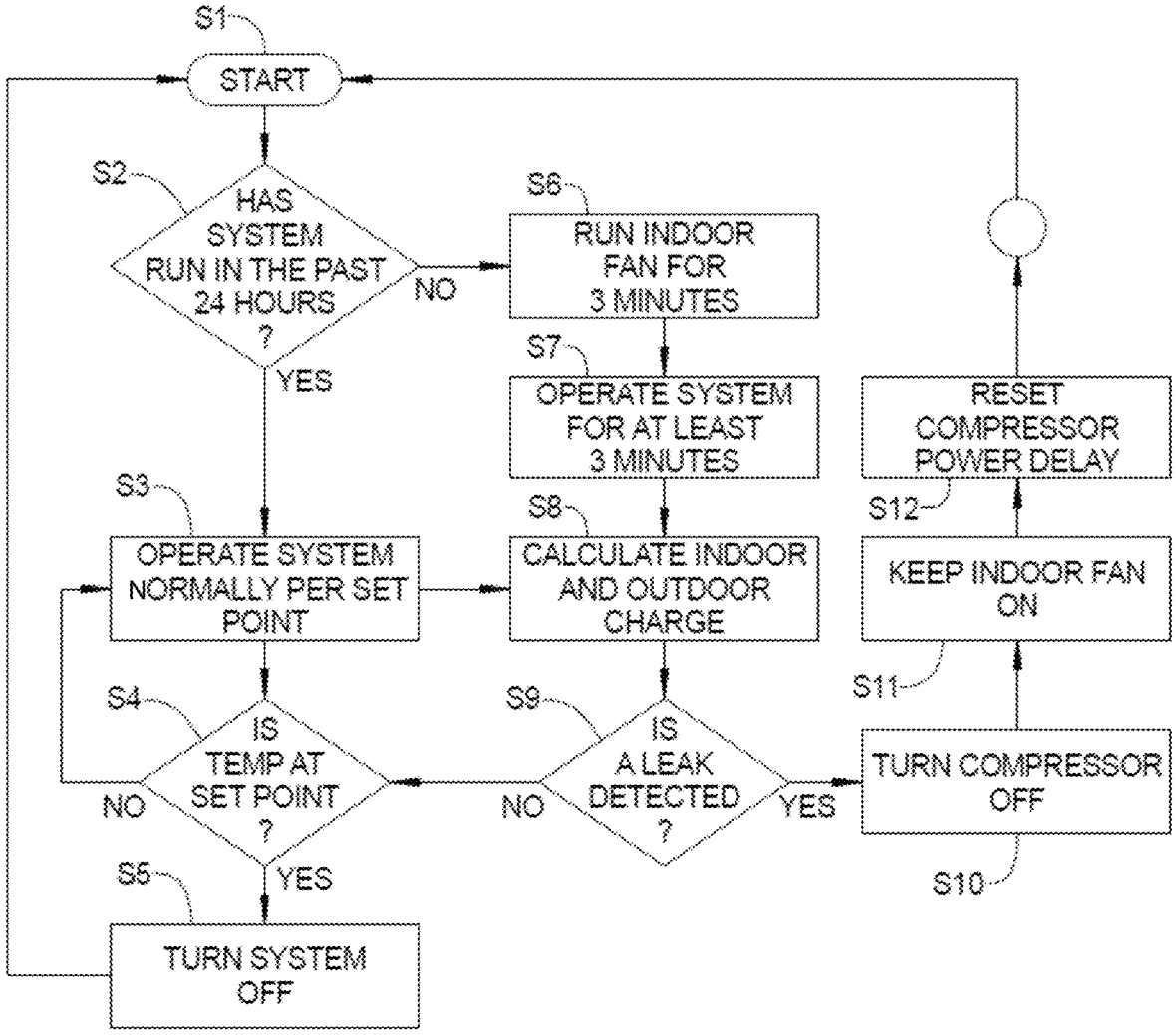
FIG. 4 is flowchart depicting an example method of controlling an indoor fan of an HVAC system.

With reference to FIG. 4, a flowchart depicting an example method of controlling a fan (e.g., fan 100) that blows air across one or more evaporators within a building is provided. The indoor fan 100 (e.g., as shown in FIG. 6) can be a whole house fan such as a furnace fan or it can be a mitigating fan, such as a bathroom fan, a hood vent fan, etc. Control starts at S1. At S2, a control module determines whether the associated refrigeration system (its compressor) has been turned on within the most recent predetermined period, such as the last 24 hours. If the refrigeration system has been turned on (ran) in the past predetermined period, control continues with S3. If not, control transfers to S6, which is discussed further below.

At S3, the control module turns on the refrigeration system (e.g., opens the isolation valves and turns on the compressor) to adjust the temperature within the building toward a set point temperature. The set point temperature may be selected via a thermostat within the building. At S4, the control module determines whether the temperature is at the set point temperature. If S4 is true, the control module turns the refrigeration system off (e.g., turns off the compressor and closes the isolation valves) at S5, and control returns to S1. If S4 is false, control returns to S3 and continues running the refrigeration system.

At S6 (when the refrigeration system has not run for within the last predetermined period), the control module turns the indoor fan on for a predetermined period, such as 3 minutes or another suitable predetermined period. At S7, the control module turns on the refrigeration system (e.g., opens the isolation valves and turns on the compressor) for the predetermined period (e.g., 3 minutes).

At S8, the control module determines the indoor and outdoor refrigerant charge amounts. The control module may determine the indoor and outdoor refrigerant charge amounts based on temperatures and/or pressures using temperature and/or pressure sensors (e.g., as discussed in FIGS. 6, 7, and 12). This may include the control module determining (e.g., real-time) densities and volume occupied by liquid, vapor, and two-phase refrigerant in the heat exchangers (evaporator(s) and condenser(s)) to calculate (e.g., real-time) refrigerant amounts within the indoor and outdoor sections using a predetermined volume of the refrigeration system and the temperatures and pressures measured, as discussed further herein.

At S9, the control module determines whether a leak is present in the refrigeration system based on the indoor and outdoor refrigerant charges relative to predetermined (e.g., previously stored) charge amounts. For example, the control module may determine that a leak is present when at least one of the indoor refrigerant charge amount is less than a predetermined indoor charge amount and the outdoor refrigerant charge amount is less than a predetermined outdoor charge amount. If no leak is detected at S9, control may transfer to S4. If a leak is detected at S9, control may continue with S10 where the control module turns the compressor OFF. Control continues with S11 where the control module maintains the indoor fan ON, such as to dissipate any leaked refrigerant that is inside the building. At S12, the control module resets the compressor power delay counter (e.g., to zero), and control returns to S1.

The control module may calculate the indoor and outdoor charges based on physical and performance characteristics, such as at least one of evaporator and condenser volume, evaporator and condenser log mean temperature difference during design, an air side temperature split, a refrigerant enthalpy change across the evaporator and/or condenser, and a ratio of overall heat transfer coefficient between two phase, vapor, and liquid of the evaporator and condenser are provided from the physical design of a system or that are observed at installation and initial operation. These characteristics may be inputs to the equations and/or lookup tables used to determine the indoor and outdoor charges or considered during calibration of the equation and/or lookup table. The control module may calculate the indoor and outdoor charges while the refrigeration system is on. The measured values can include at least one of a liquid line temperature, a suction line temperature, an outdoor ambient temperature, an evaporator temperature, a suction pressure, a condenser temperature liquid pressure, a condenser pressure, and a discharge pressure as sensed by temperature sensors and pressure sensors of the refrigeration system.

The control module may determine the indoor charge of the refrigeration system, for example, based on an evaporator charge and a liquid line charge calculation. The control module may determine an indoor total volume and a liquid line volume, for example, by performing a pump down operation, such as described above. The calculation of the indoor charge allows the control module to actively control the indoor charge amount and maintain the indoor charge amount below the predetermined amount (M1).

The calculation of indoor charge allows for optimization of refrigerant charge balance for system efficiency in response to system capacity. This may additionally include the control module controlling capacity of the compressor(s). The calculation of the total system charge allows detection and quantification of refrigerant leakage enabling an alert, an isolation of the indoor space, and a mitigation of leakage. The calculation of the total system charge also allows for calculation of total refrigerant emission.

The charge calculation may be based upon various data including fixed data including condensing unit manufacturer data may be performed as follows:

- $V_{displacement}$ ●Compressor displacement volume (e.g., $in^3$/min);
- $V_{condensing\ unit}$ ●Internal volume of the condensing unit between the isolating valves from the original equipment manufacturer (OEM) model geometry;
- $\Delta T_{log\ mean,\ evap\ 2\phi,\ design}/(h_{evap\ sat}-h_{evap\ inlet})_{design}$ ●Standard ratio for log mean temperature difference and enthalpy change of the evaporator two phase section based on design;
- $\Delta T_{log\ mean,\ evap\ vap,design}/(h_{evap\ ouletsat}-h_{evap\ sat})_{design}$ ●Standard ratio for log mean temperature difference and enthalpy change of the evaporator vapor section based on design; and
- $U_{ratio}=U_{evap\ 2\phi}/U_{evap\ vap}$ ●Standard value for the overall heat transfer coefficient of the two phase section ratio with the overall heat transfer coefficient of the vapor section.

The charge calculation may be further based upon variable measurement data as follows:

- $T_{suction}$ ●Temperature of refrigerant between a vapor service valve and the vapor isolation valve (or between the vapor service valve and evaporator if only one valve in the line);
- $T_{liquid}$ ●Temperature of the refrigerant between the condenser and the liquid isolation valve (or liquid service valve in absence of isolation valves);
- $P_{suction}$ ●Pressure of refrigerant between the vapor service valve and the vapor isolation valve (or between the vapor service valve and evaporator if only one valve is implemented in the line); and
- $P_{liquid}$ ●Pressure of the refrigerant between the condenser and the liquid isolation valve (or liquid service valve in absence of isolation valves).

The charge calculated data may include a first data subset including:

- $V_{indoor}$ ●Internal volume between the liquid isolation valve and the compressor including evaporator, liquid line, and suction line which may be calculated by rate of pressure drop during a pump down (or entered, such as at installation, in absence of isolation);
- $T_{discharge}$ ●Discharge temperature of the refrigerant, such as estimated from regression model of refrigerant property data using the measured suction condition, the measured liquid pressure, and a predetermined isentropic efficiency of the compression process (e.g., in the range 60-75%);
- $T_{liquid}$, $v_{liquid}$, $h_{liquid}$ ●Temperature, specific volume, and enthalpy of liquid refrigerant leaving the condensing unit, such as estimated from a regression model of refrigerant property data using liquid temperature;
- $T_{evap\ inlet}$, $v_{evap\ inlet}$, $h_{evap\ inlet}$ ●Temperature, specific volume, and enthalpy of refrigerant entering the evaporator, such as estimated from a regression model of refrigerant property data using liquid temperature and suction pressure;
- $T_{evap\ sat}$, $v_{evap\ sat}$, $h_{evap\ sat}$ ●Temperature, specific volume, and enthalpy of saturated vapor refrigerant in the evaporator(s), such as estimated from a regression model of refrigerant property data using suction pressure; and
- $T_{evap\ outlet}$, $v_{evap\ outlet}$, $h_{evap\ outlet}$, $\rho_{evap\ outlet}$ ●Temperature, specific volume, enthalpy, and density of refrigerant leaving the evaporator(s), such as estimated from a regression model of refrigerant property data using suction temperature and pressure.

The charge calculated data may include a second data subset including:

- $v_{discharge}$, $h_{discharge}$ ●specific volume and enthalpy of refrigerant vapor entering the condensing unit, such as estimated from a regression model using discharge temperature and liquid pressure;
- $T_{cond\ sat\ vap}$, $v_{cond\ sat\ vap}$, $h_{cond\ sat\ vap}$ ●Temperature, specific volume, and enthalpy of saturated vapor refrigerant in the condenser(s), such as estimated from a regression model using liquid pressure;
- $T_{cond\ sat\ liq}$, $v_{cond\ sat\ liq}$, $h_{cond\ sat\ liq}$ ●Temperature specific volume and enthalpy of saturated vapor refrigerant in the condenser, such as estimated from a regression model using liquid pressure;
- $U_{evap\ vap}$ ●Overall heat transfer coefficient in the vapor only section of the evaporator, such as only used in a ratio with the two-phase section;
- $U_{evap\ 2\phi}$ ●Overall heat transfer coefficient in the two phase section of the evaporator, such as only used in a ratio with the vapor only section;
- $v_{liquid}$ ●Internal volume of the liquid line between the isolation valve and the expansion valve; and
- $v_{evaporator}$ ●Internal volume of the evaporator and suction line.

A pump down commissioning calculation includes the control module calculating the total volume of the indoor system and the volume of the liquid line based on, for example, a total amount of refrigerant removed during a pump down and a rate of change in pressure and density during the pump down after liquid refrigerant has been removed. The use of a vapor pump down rate of change in pressure and density may be used by the control module to estimate total volume. This may be described by the following equations:

$$\text{Total Pump out Charge Mass}=\Sigma(\rho_{evap\ outlet}\cdot V_{displacement}\cdot\Delta t_{measurement}),$$

during the full duration of the pump out;

$$V_{indoor}=\Sigma[(V_{displacement}\cdot\rho_{evap\ outlet}\cdot\Delta t_{measurement})/(\rho_{evap\ outlet,\ previous\ measurement}-\rho_{evap\ outlet})];$$

in the time after all liquid has been removed as observed by a (e.g., sharp) change in the suction pressure; and $$\text{Total Pump Down Charge Mass}=V_{liquid}/v_{liquid}+2\cdot\%A_{2\phi}\cdot V_{evaporator}/(v_{evap,in}+v_{evap,sat})+2\cdot\%A_{vap}\cdot V_{evaporator}(v_{evap,sat}+v_{evap\ outlet})$$

Balancing the three equations above using data from an end of a run cycle of the refrigeration system before the pump down may be used to populate the third combined equation with the pump down calculations from the $1^{st}$ and $2^{nd}$ equations. With the three above equations, $V_{liquid}$ and $V_{evaporator}$ can be solved by the control module. In the absence of actuated isolation valves, $V_{liquid}$ and $V_{evaporator}$ may be estimated by an installer and stored. The terms pump down and pump out can be used interchangeably.

The operating calculation of indoor charge may use a standard equation isolating vapor heat transfer, such as follows:

$$Q_{evap\ vap}=m_{evap\ outlet}\cdot(h_{evap\ outlet}-h_{evap\ sat});\ \text{and}$$

$$Q_{evap\ 2\phi}=m_{evap\ outlet}\cdot(h_{evap\ sat}-h_{evap\ inlet}).$$

An equation for compressor mass flow rate is as follows:

$$m_{evap\ outlet}=V_{displacement}\cdot\rho_{evap\ outlet}.$$

The present disclosure enables use of design condition data from the OEM to calculate the percent of the heat transfer area (% A) of the evaporator used for 2-phase heat transfer and for superheating vapor by the control module. The formulas above may be based on thermodynamic physical calculations with the assumption that some ratios will be consistent between daily operation and an OEM design condition.

A heat transfer by region may be calculated as follows:

$$Q_{evap\ vap}=U_{evap\ vap}\cdot\%A_{vap}\cdot A_{tot}\cdot\Delta T_{log\ mean,\ vap};$$

$$Q_{evap\ 2\phi}=U_{evap\ 2\phi}\cdot\%A_{evap\ 2\phi}\cdot A_{tot}\cdot\Delta T_{log\ mean,\ evap\ 2\phi};$$

A percent of area for vapor and 2-phase may be calculated as follows:

$$\%A_{vap}=m_{evap\ outlet}\cdot(h_{vap\ outlet}-h_{evap\ sat})/(U_{evap\ vap}\cdot A_{tot}\cdot\Delta T_{log\ mean,\ vap});$$

$$\%A_{evap\ 2\phi}=m_{evap\ outlet}\cdot(h_{evap\ sat}-h_{evap\ inlet})/(U_{evap\ 2\phi}\cdot A_{tot}\cdot\Delta T_{log\ mean,\ evap\ 2\phi});$$

A ratio of percent of area for vapor and 2-phase may be calculated as follows:

$$\%A_{vap}/\%A_{evap\ 2\phi}=(h_{evap\ outlet}-h_{evap\ sat})\cdot U_{evap\ 2\phi}\cdot\Delta T_{log\ mean,\ evap\ 2\phi}/[(h_{evap\ sat}-h_{evap\ inlet})\cdot U_{evap\ vap}\cdot\Delta T_{log\ mean,\ vap}];$$

$$\%A_{vap}+\%A_{evap\ 2\phi}=1.$$

A log mean temperature difference of each region may be calculated as follows:

$$\Delta T_{log\ mean,\ evap\ 2\phi}=[\Delta T_{log\ mean,\ evap\ 2\phi,design}/(h_{evap\ sat}-h_{evap\ inlet})_{design}]\cdot(h_{evap\ sat}-h_{evap\ inlet});$$

and $$\Delta T_{log\ mean,\ evap\ vap}=[\Delta T_{log\ mean,\ evap\ vap,design}/(h_{evap\ oulet}-h_{evap\ sat})_{design}]\cdot(h_{evap\ outlet}-h_{evap\ sat}).$$

The calculations described herein may be calculated by a control module. The calculation of total indoor charge may be completed using properties of refrigerant specific volume. Specific volume may be approximately linearly related to enthalpy within each phase region allowing inlet and outlet of the phase region to calculate a reliable average specific volume for the phase region. By combining this with calculating a percent of a heat transfer area of the evaporator used for 2-phase heat transfer and for vapor superheating, the evaporator refrigerant mass is calculated by the control module. With known liquid density upstream of the expansion device and a liquid line volume, the liquid line refrigerant mass can be calculated by the control module for combination to estimate an indoor refrigerant charge amount (e.g., mass) according to the following equation:

$$\text{Indoor refrigerant charge mass}=\text{Liquid line refrigerant mass}+\text{Evaporator refrigerant mass};$$

where $$\text{Liquid line refrigerant mass}=V_{liquid}/V_{liquid};\ \text{and}$$

$$\text{Evaporator refrigerant mass}=2\cdot\%A_{2\Phi}\cdot V_{evaporator}/(V_{evap,in}+V_{evap,sat})+2\cdot\%A_{vap}\cdot V_{evaporator}(V_{evap,sat}+V_{evap\ outlet}).$$

A similar calculation can be performed by the control module to determine the condenser or outdoor side ($M_{outdoor}$) amount (e.g., mass m) in order to observe a change in the total mass ($M_{indoor}+M_{outdoor}$). The control module may determine whether a leak is present based on the change in the total mass. Additionally or alternatively, the outdoor side amount may be used by the control module to determine when there is a leak in the system. Less than 4 ounce charge removals can be observed in the calculation when there is not a charge reservoir like an accumulator or receiver.

The calculated indoor charge may be used by the control module to verify while running that the indoor charge amount is maintained less than the predetermined (M1) amount as determined by the refrigerant concentration limit (RCP). The RCP limit may be 25% of a lower flammability limit for the A2L refrigerant and other flammable refrigerants. The (e.g., total) charge amount at the end of the on-cycle is held constant through the off cycle with the use of charge isolation valves.

To summarize, the control module may control the isolation valves to maintain a (e.g., indoor) charge amount below the predetermined amount (M1) inside an occupied building. Other ways to determine the amount of refrigerant within a system may be used, such as those based on installation, commissioning, continuous commissioning, service contract monitoring, and servicing of the system. The indoor charge amount $M_{indoor}$(i.e. mass) can be confirmed to be below the predetermined amount (M1) or another suitable amount allowed according to one or more regulations.

The refrigerant of the vapor compression system can be a refrigerant such as R-410A, R-32, R-454B, R-444A, R-404A, R-454A, R-454C, R-448A, R-449A, R-134a, R-1234yf, R-1234ze, R-1233zd, or other type of refrigerant.

The properties of the refrigerant used to determine the densities and volume occupied may be calculated by the control module based on the measured values and the properties of the refrigerant.

The evaporator and condenser (heat exchangers) may include finned tube, concentric, brazed plate, plate and frame, microchannel, or other heat exchangers with (e.g., constant) internal volume. There may be a single evaporator and condenser or multiple parallel evaporators or condensers, such as discussed above. Refrigerant flow can be controlled via a capillary tube, thermostatic expansion valve, electric expansion valve, or other methods.

As detailed above with respect to FIG. 4, the amount of refrigerant may be determined by the control module based on measurements from the pressure and temperature sensors, such as those shown in FIG. 6. FIG. 6 provides a method of controlling the isolation valves to isolate refrigerant charge in outdoor components of a refrigeration system based on the calculated refrigerant charge amount. Isolation control of some type may be present on both the liquid and suction line including at least one of dedicated isolation valves, a positive seat compressor, a suction check valve, and a positive seat electronic expansion valve. The isolation valve control can react automatically or in response to control in changes in the system operational state and the identification of a leak.

The isolation valves 20, 22 may be actuated (e.g., closed) by the control module at the end of an operational cycle (e.g., when the refrigeration system is turned off), such as to ensure that the indoor charge amount does not exceed the predetermined amount (M1). The isolation valves 20, 22 are opened by the control module at startup of the refrigeration system. This permits starting of the compressor 12 by the control module. While the refrigeration system is off, refrigerant charge balance between the indoor and outdoor sections may be controlled by the control module by controlling, for example, auxiliary heat or cooling. This may enable shorter periods of instability and low (compressor) capacity at the beginning of an operational cycle (e.g., when the refrigeration system is turned on). This may reduce energy loss caused by the operational (on/off) cycling of the refrigeration system. The indoor charge of a flammable refrigerant is maintained by the control module below the predetermined amount (M1).

In the example of FIG. 6, the control module closes the isolation valves 20, 22 when a leak is detected to isolate the refrigerant charge outside of the building to prevent continued leaking of refrigerant within the building. When the compressor is running, the liquid-side isolation valve 22 may be closed by the control module while the suction side isolation valve is held open upon detection of a leak. This may allow the refrigerant to be pumped out of and isolated outside of the building. The control module may operate the compressor(s) and hold the suction side isolation valve(s) open, for example, until a predetermined suction pressure and/or a predetermined evaporator temperature is reached. This may indicate that the predetermined amount (M1) has been achieved indoors. The control module may switch the compressor(s) off and close all isolation valves. The isolation valves 20, 22 are sequentially closed in advance of the end of the operational cycle to permit valve closing to align in time with the end of the cycle. Manual or automatic actuation of the isolation valves allows isolation of the system for service or commissioning. In various implementations, the isolation valves may be condensing unit valves retrofitted with (electronic) automated actuators.

A pump down can be performed by the control module during commissioning, for example, to establish the volume and operating indoor charge or liquid line volume on the indoor section of the isolation valves 20, 22. The volume data can be stored for future reference, such as for use in the charge calculation equation.

For example, during actual testing using the pump down technique described herein in a residential home HVAC system charged with 15 pounds (Lbs) 8 ounces (oz) of refrigerant, after operation of the HVAC system with no pump down, 3 Lbs. 4 oz. of refrigerant remained within the indoor section of the HVAC system. In an HVAC system charged with 15 Lbs. 8 oz. of refrigerant, after operation of the system with a 15 second pump down, 1 Lb. 6.2 oz. of refrigerant remained within the indoor section of the HVAC system. Finally, in an HVAC system charged with 15 Lbs. 8 oz. of refrigerant, after operation of the system with 30 second pump down, just 7.2 oz. of refrigerant remained within the indoor section of the HVAC system.

Figure 7:
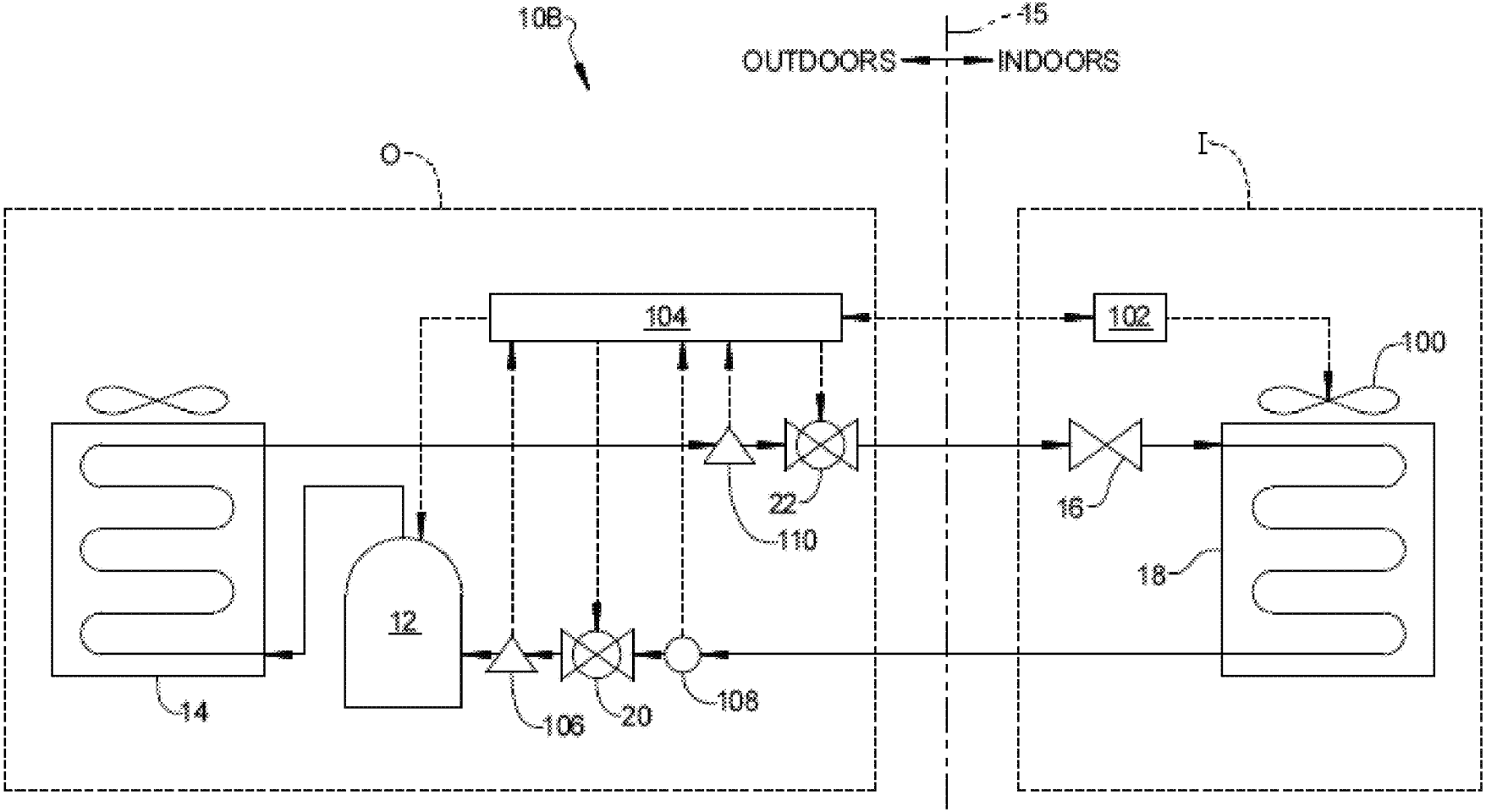
FIG. 7 is a functional block diagram of an example air conditioning system including isolation valves, pressure sensors, and temperature sensors.

With reference to FIG. 7 a functional block diagram of an example refrigeration system 10B including isolation valves and pressure and temperature sensors is provided. As shown in FIG. 7, the refrigeration system includes a compressor 12 and a condenser 14 disposed outdoors of a building 15 (i.e., outdoors). An expansion valve 16 and an evaporator 18 are disposed inside of the building 15 (i.e., indoors).

A first isolation valve 20 is disposed, for example, outside of the building and between the evaporator 18 and the compressor 12. A second isolation valve 22 is disposed, for example, outside of the building and between the condenser 14 and the expansion valve 16.

A fan 100 is provided adjacent to the evaporator 18 and blows air across the evaporator 18 when on. A first control module 102 controls operation of the fan 100. A second control module 104 calculates indoor and outdoor charge amounts, for example, based on measurements from a first temperature sensor 106 and a first pressure sensor 108 disposed between the evaporator 18 and the compressor 12 and a second temperature sensor 110 disposed between the condenser 14 and the expansion valve 16. The control module may determine the indoor and outdoor charge amounts while the refrigeration system is ON. If an overall system charge amount decreases, the control module may determine that a leak is present. The control module may determine the overall (or total) system charge amount, for example, based on or equal to a sum of the indoor and outdoor charge amounts.

If a leak is detected, the second control module 104 may initiate a pump out. This may include the second control module 104 closing the second isolation valve 22 and running the compressor 12. This may pump down refrigerant from the indoor side I to the outdoor side O of the refrigeration system. The second control module 104 may close the first isolation valve 20 and turn off the compressor to isolate the outdoor section O of the system from the indoor section I of the system when the pump out is complete. The second control module 104 may prompt the first control module 102 to turn ON the fan 100 and/or one or more other mitigation devices, such as to dissipate/dilute any leaked refrigerant within the building. The pressure sensor 108 can be used to detect a leak by detecting a pressure decay from the indoor side of the system 10B.

Figure 8:
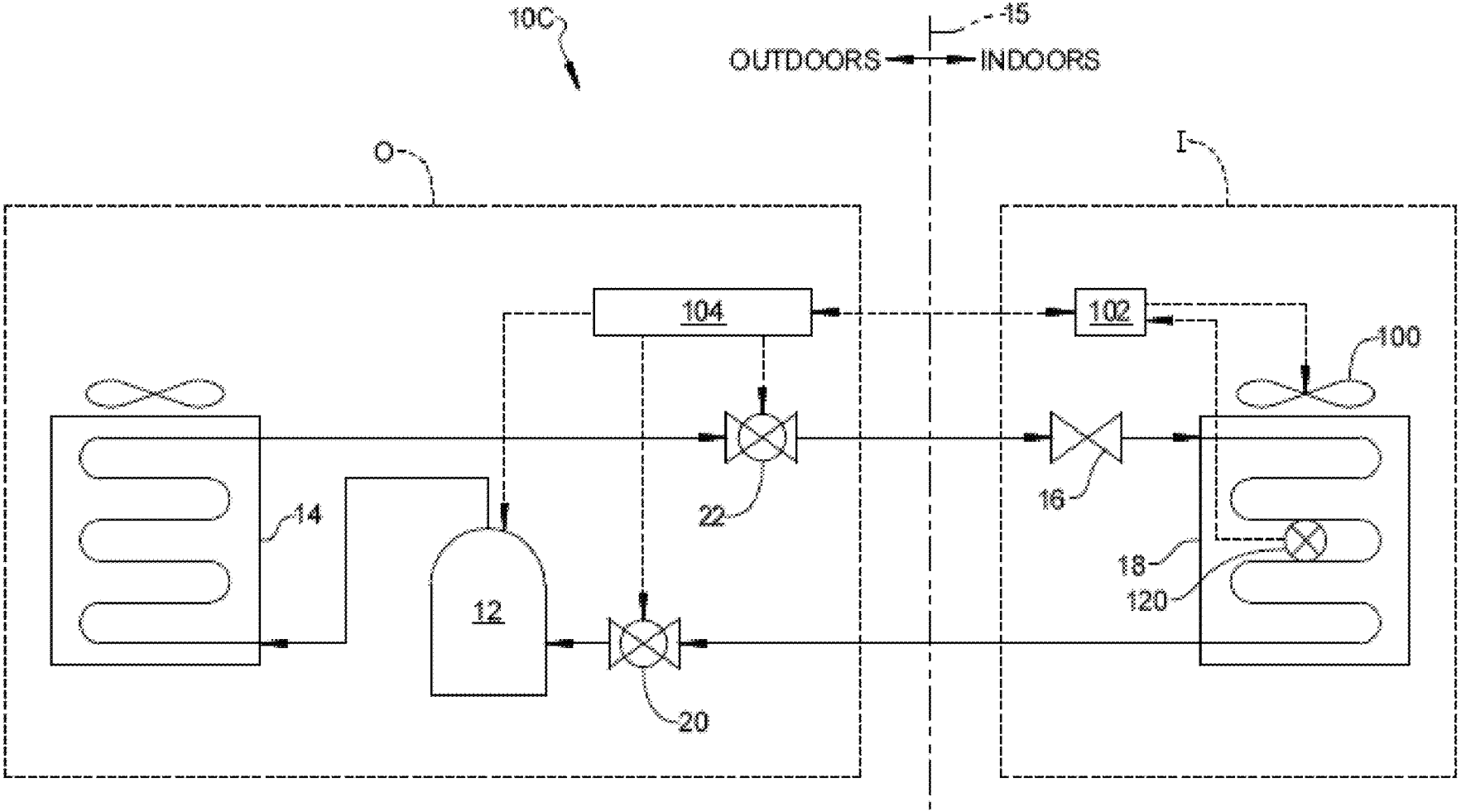
FIG. 8 is a functional block diagram of an example air conditioning system for including isolation valves and a leak sensor.

With reference to FIG. 8 a functional block diagram of an example implementation of a refrigeration system 10C is presented. The refrigeration system may include compressor 12 and a condenser 14 outside of a building 15 (i.e., outside).

An expansion valve 16 and an evaporator 18 is disposed inside of the building 15 (i.e., indoors).

A first isolation valve 20 is disposed, for example, inside of the building and between the evaporator 18 and the compressor 12. A second isolation valve 22 is disposed, for example, outside of the building and between the condenser 14 and the expansion valve 16.

A fan 100 is provided adjacent to the evaporator 18 and is controlled by a first control module 102. A second control module 104 may control the compressor 12 and the isolation valves 20, 22, such as in response to signals from the first control module 102.

A refrigerant leak sensor 120 is provided in the indoor unit and can be adjacent to the evaporator 18. The refrigerant leak sensor 120 may indicate whether a refrigerant leak is present. In the system of FIG. 8, the first control module 102 receives signals from the leak sensor 120 and communicates with the second control module 104 if a leak is detected. When a leak is detected, the second control module 104 initiates a pump down sequence. This may include closing the second isolation valve 22 and running the compressor 12 to pump down refrigerant from inside of the building to the outside of the building. The second control module 104 closes the first isolation valve 20 and turns off the compressor 12 when the pump down is complete to isolate the outdoor section O of the system from the indoor section I of the system.

The second control module 104 also communicates with the first control module 102, such as to turn ON the fan 100 and/or one or more other mitigation devices, such as to dissipate any leaked refrigerant or prevent/lockout operation of any ignition sources. The isolation valves 20, 22, compressor 12, or expansion device 16 control the total refrigerant charge, such as to minimize or maintain the charge amount less than the predetermined amount (M1) during both compressor operational and compressor non-operational times.

Figure 9:
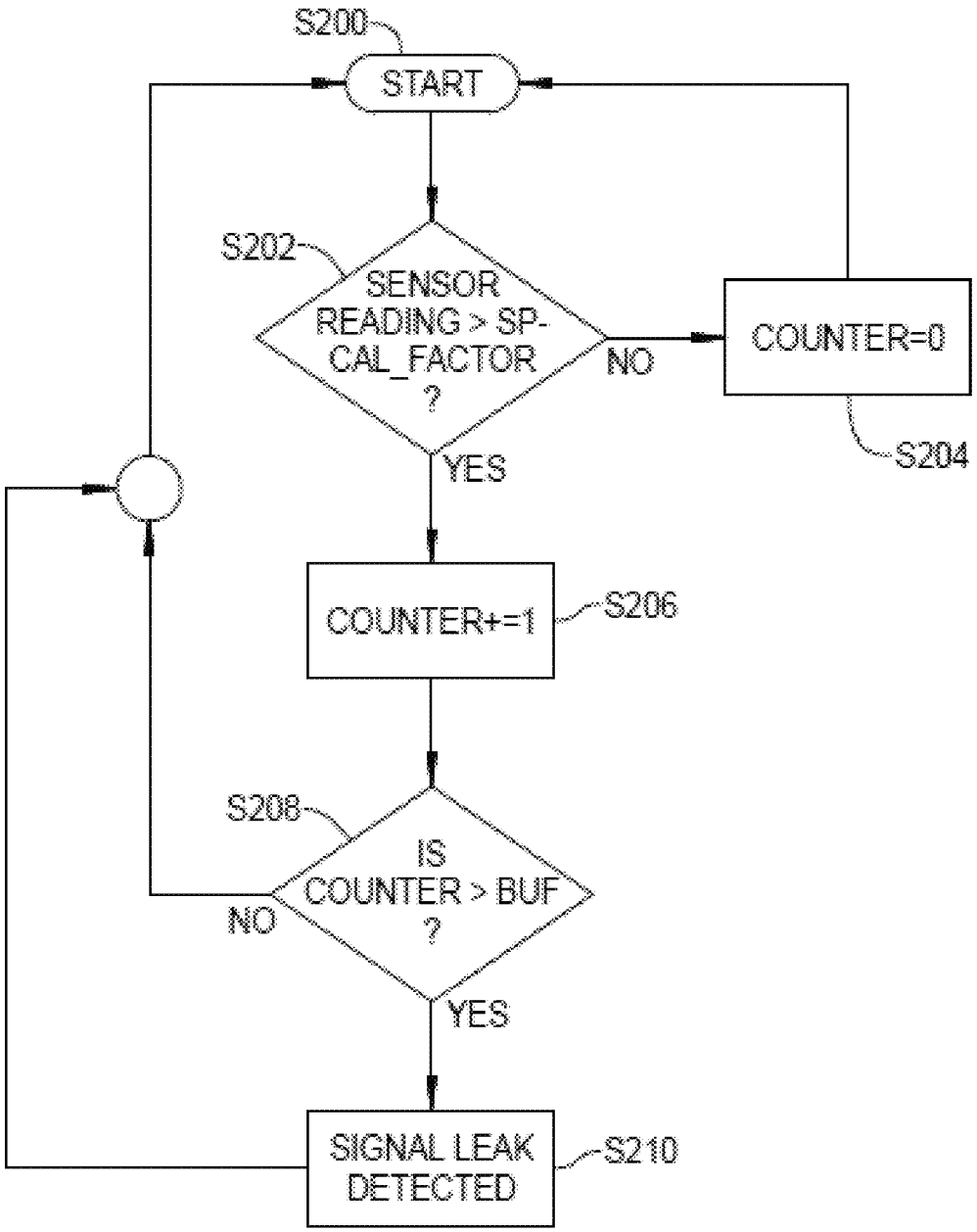
FIG. 9 is a flowchart depicting an example method of refrigerant leak detection.

FIG. 9 is flowchart depicting an example method of refrigerant leak detection using a leak sensor 120. Control begins with S200. At S202, a control module determines whether a measurement of the leak sensor is greater than a predetermined value. For example, the leak sensor may measure a concentration of the refrigerant in air at the leak sensor. When the concentration (e.g., parts per million or parts per billion) is not greater than the predetermined concentration or amount, control continues with S204. In various implementations, a calibrated amount may be subtracted from the predetermined value (or set point, SP). At S204 the control module sets a counter value to zero and control returns to S200. If the control module determines whether the measurement from the sensor is greater than the predetermined value, control continues with S206.

At S206, the control module increments the counter value (e.g., by 1), and control continues with S208. At S208, the control module determines whether the counter value is greater than a predetermined value. If S208 is true, the control module determines and indicates that a leak is present at S210, and control returns to S200. If S208 is false, the control module may determine that a leak is not present, and control returns to S200. The predetermined value is greater than zero and may be greater than 1. By requiring the counter value to be greater than 1, control ensures that an actual leak is present by requiring that the measurement be greater than the predetermined value for multiple consecutive sensor readings. This may avoid nuisance alerts/lockouts regarding leakage.

Figure 10:
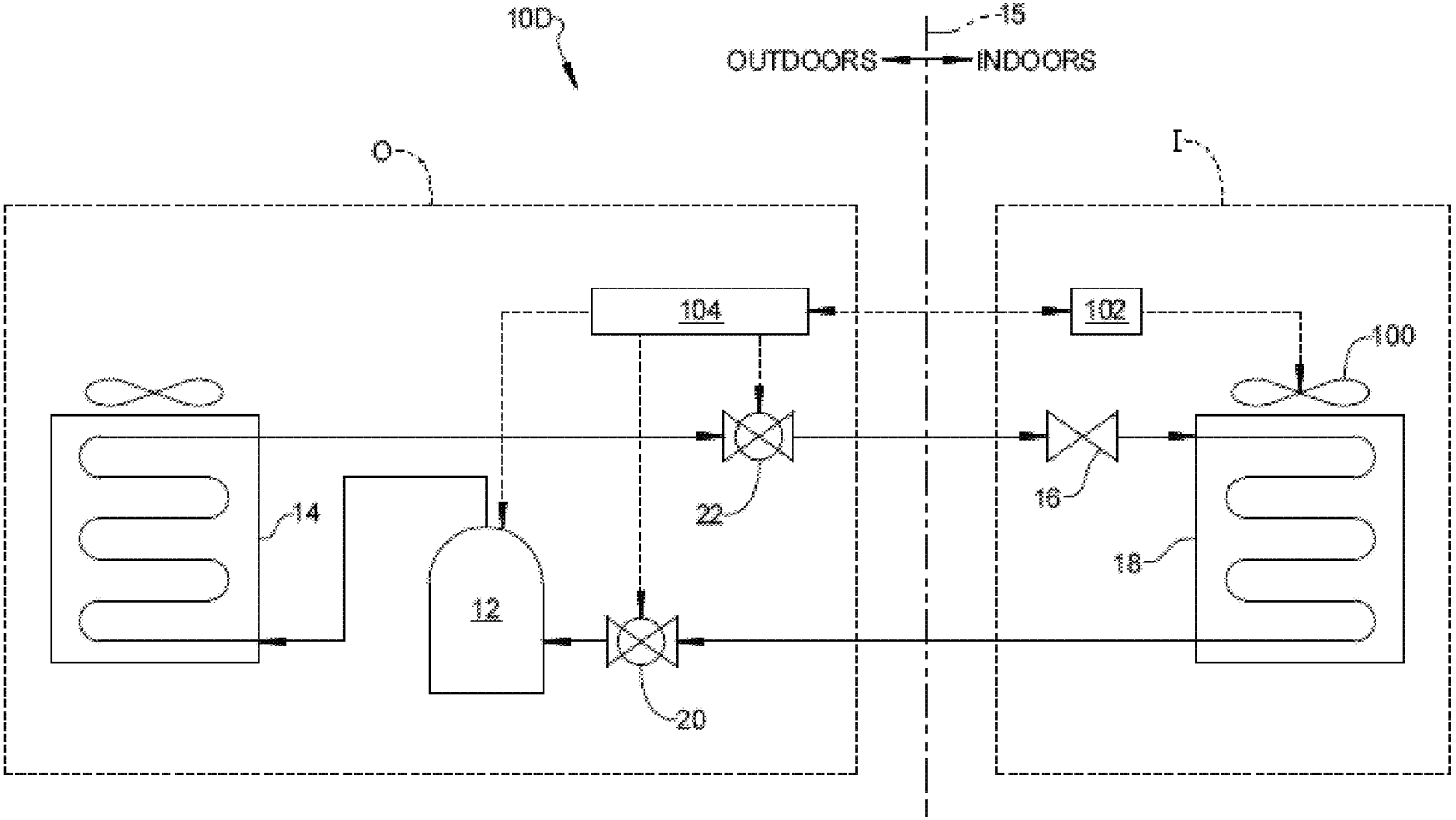
FIGS. 10 and 11 are functional block diagrams of example refrigeration systems including isolation valves.

FIG. 10 is a functional block diagram of an example refrigeration (e.g., air conditioning) system 10D. The system 10D includes a compressor 12 and a condenser 14 disposed outside of the building 15 (i.e., outdoors), and includes an expansion valve 16 and an evaporator 18 disposed inside of the building 15 (i.e., indoors).

A first isolation valve 20 is disposed, for example, outside of the building 15, and between the evaporator 18 and the compressor 12. A second isolation valve 22 is disposed, for example, outside of the building 15, and between the condenser 14 and the expansion valve 16.

A fan 100 is provided adjacent to the evaporator 18 may be controlled by a first control module 102. When on, the fan 100 blows air across the evaporator 18. A second control module 104 may control the compressor 12 and the isolation valves 20, 22.

In the example of FIG. 10, the first control module 102 communicates with the second control module 104 to indicate whether cooling is demanded or not. For example, the first control module 102 may set a signal to a first state when cooling is demanded and set the signal to a second state when cooling is not demanded. While the example of separate control modules (first and second control modules) is described herein, in various implementations, the multiple control modules may be integrated within a single control module.

The second control module 104 may selectively perform a pump down, such as when a leak is detected or when a cooling demand stops. The pump down may include the second control module 104 closing the second isolation valve 22 closed and maintaining the compressor 12 on for a predetermined period. After the predetermined period has passed, the second control module 104 may close the first isolation valve 20 and turn off the compressor 12. This may isolate refrigerant in the outdoor section O of the system and isolate refrigerant from the indoor section I. This may ensure that the amount of refrigerant within the indoor section I when the compressor 12 is off is less than the predetermined amount (M1).

Figure 11:
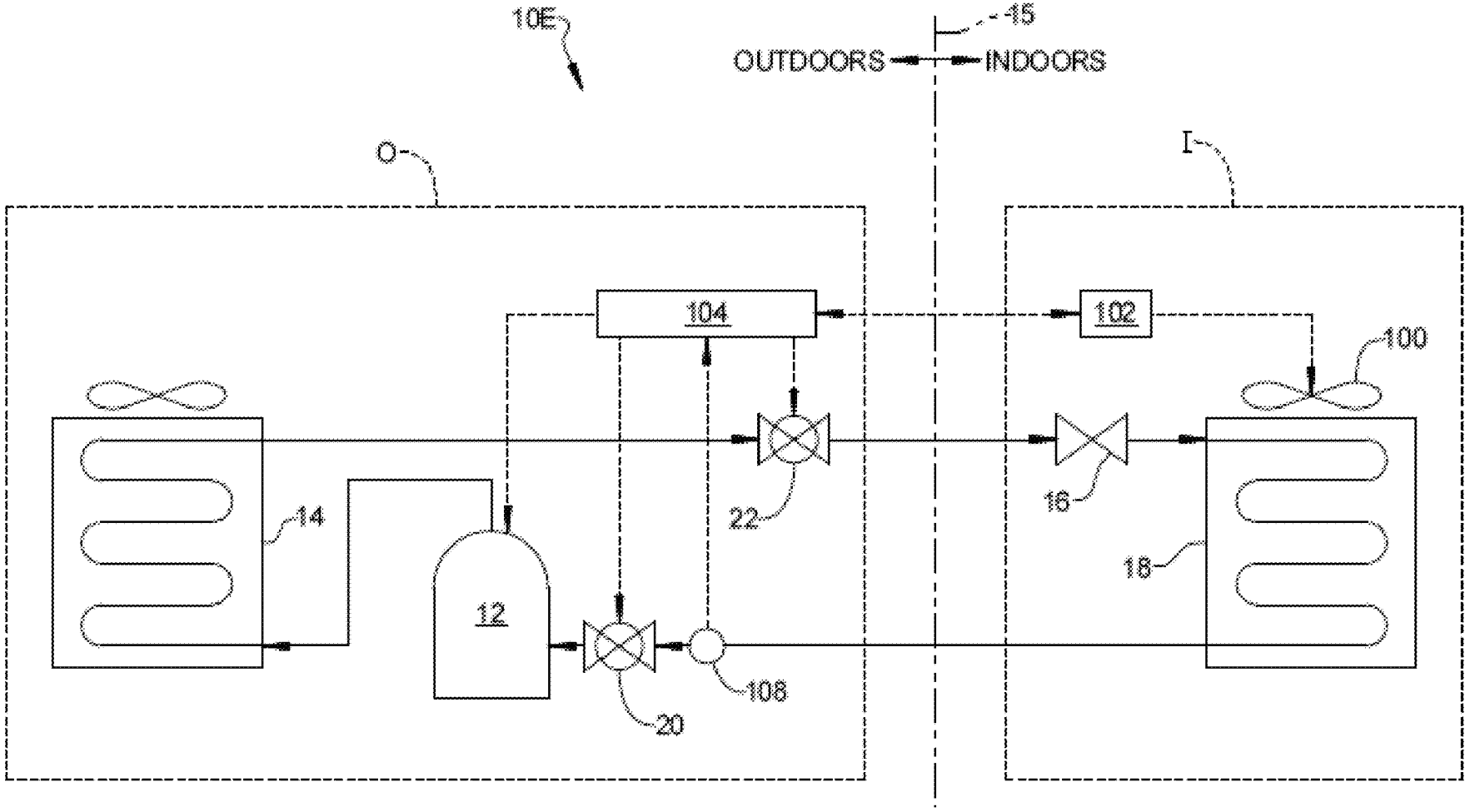

FIG. 11 includes a functional block diagram of an example refrigeration (e.g., air conditioning) system 10E. The system 10E is shown including a compressor 12 and a condenser 14 disposed outside of the building 15 (i.e., outdoors) and includes an expansion valve 16 and an evaporator 18 disposed inside of the building 15 (i.e., indoors).

A first isolation valve 20 is disposed, for example, outside of the building 15 and between the evaporator 18 and the compressor 12. A second isolation valve 22 is disposed, for example, outside of the building 15, and between the condenser 14 and the expansion valve 16.

A fan 100 is provided adjacent to the evaporator 18 and may be controlled by a first control module 102. When on, the fan 100 blows air across the evaporator 18, such as to cool the air within the building 15. A second control module 104 may control the compressor 12 and the isolation valves 20, 22.

The first control module 102 communicates with the second control module 104 to indicate whether cooling has been demanded, such as described above. The second control module 104 can selectively perform a pump down, such as when the demand for cooling stops. This may include the second control module 104 closing the second isolation valve 22 closed and maintaining the compressor 12 on for a predetermined period after the demand for cooling ends. Once the predetermined period has passed, the second control module 104 may turn off the compressor 12 and close the first isolation valve 20. This may isolate the refrigerant in the outdoor section O of the system such that the amount of refrigerant within the indoor section I is less than the predetermined amount (M1) while the compressor 12 is off.

A pressure sensor 108 can be disposed between the evaporator 18 and the first isolation valve 20. Additionally or alternatively, a pressure sensor (or the pressure sensor 108) can be disposed between the expansion valve 16 and the isolation valve 22.

The pressure sensor 108 measures the pressure in the indoor section I, such as for a decay in pressure, when the system is off (e.g., the isolation valves are closed and the compressor 12 is off). The second control module 104 may determine and indicate that a refrigerant leak is present when the pressure (or an absolute value of the pressure) measured by the pressure sensor 108 decays (e.g., decreases by at least a predetermined amount). When a leak is detected, the second control module 104 may prompt the first control module 102 to turn the fan 100 ON. A control module may also turn on one or more other mitigation devices in order to dissipate/dilute the refrigerant within the building.

Figure 12:
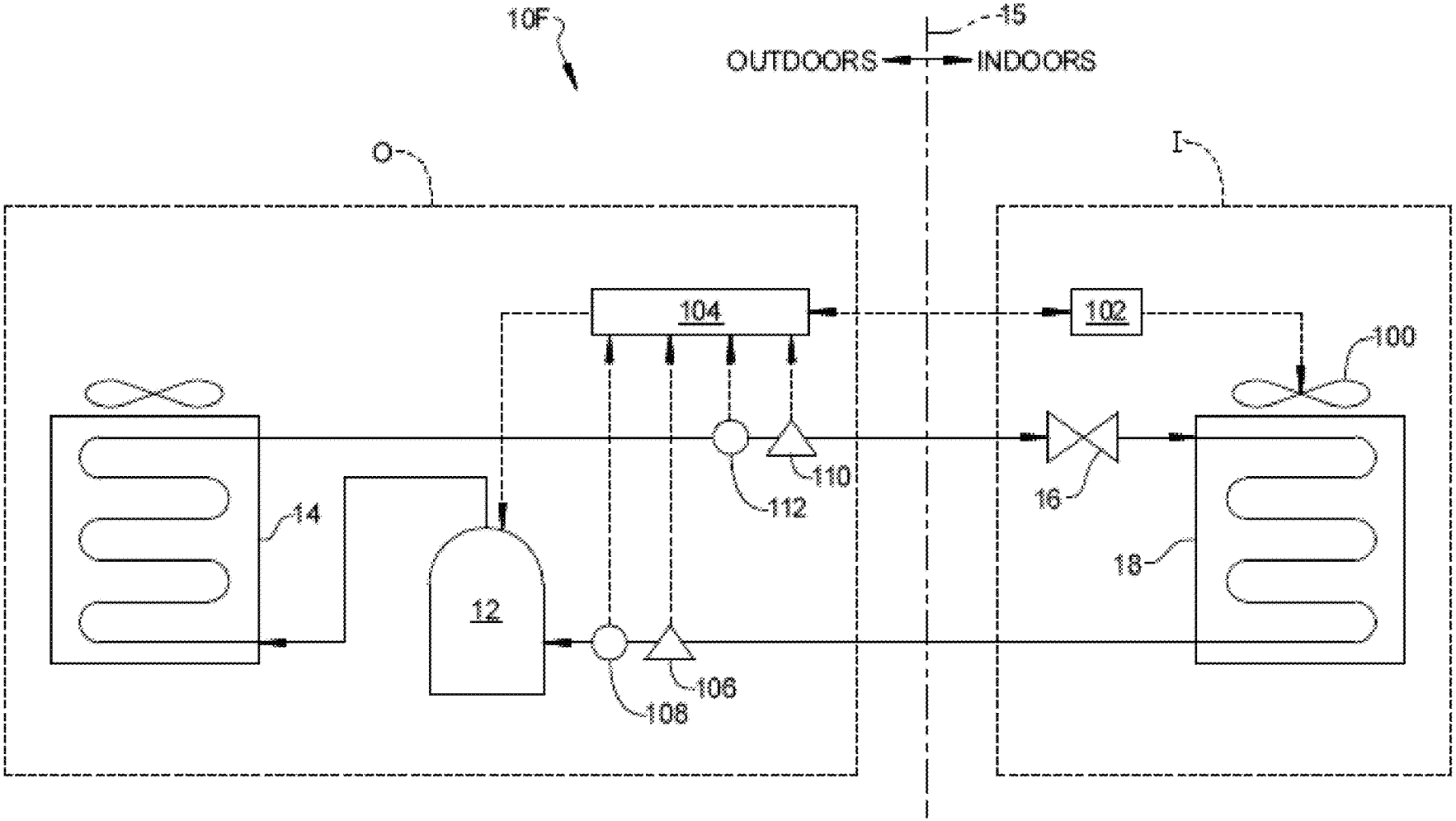
FIG. 12 is a functional block diagram of an example refrigeration system including pressure and temperature sensors.

FIG. 12 is a functional block diagram of an example refrigeration (e.g., air conditioning) system 10F. The system 10F is shown including a compressor 12 and a condenser 14 disposed outside of the building 15 (i.e., outdoors) and includes an expansion valve 16 and an evaporator 18 disposed inside of the building 15 (i.e., indoors).

A fan 100 is provided adjacent to the evaporator 18 and may be controlled by a first control module 102. When on, the fan 100 blows air across the evaporator 18, such as discussed above. A second control module 104 may control the compressor 12. The second control module 104 may calculate indoor and outdoor charge amounts based on measurements from a first temperature sensor 106 and a first pressure sensor 108 disposed between the evaporator 18 and the compressor 12 and based on measurements from a second temperature sensor 110 and a second pressure sensor 112 disposed between the condenser 14 and the expansion valve 16. The amount of indoor and outdoor charge level may be calculated while the HVAC system is ON (e.g., the compressor is ON and the isolation valve(s) are open) based upon the measurements of the pressure sensors 108, 112 and the temperature sensors 106, 110. The second control module 104 may determine the indoor charge amount, for example, using an equation or a lookup table that relates the measured pressures and temperatures to indoor charge amounts. The second control module 104 may determine the outdoor charge amount, for example, using an equation or a lookup table that relates the measured pressures and temperatures to outdoor charge amounts.

The second control module 104 may determine a total (overall) system charge amount based on the indoor and outdoor charge amounts. The second control module 104 may determine the total charge amount, for example, using an equation or a lookup table that relates the indoor and outdoor charge amounts to total charge amounts. For example, the second control module 104 may set the total charge amount based on or equal to the indoor charge amount plus the outdoor charge amount.

If the total charge amount decreases, the second control module 104 may determine and indicate that a leak is present. If a leak is detected, the second control module 104 may turn off the compressor 12. The second control module 104 may prompt the first control module 102 to turn ON the fan 100. A control module may also turn on one or more other mitigation devices to dilute/dissipate any leaked refrigerant.

Figure 13:
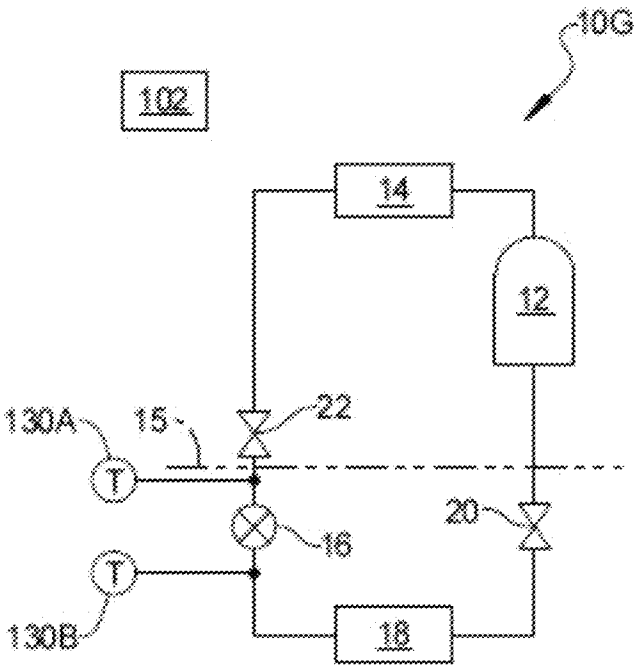
FIG. 13 is a functional block diagram of an example refrigeration system including temperature or pressure sensors.

FIG. 13 is a functional block diagram of an example refrigeration (e.g., air conditioning) system 10G. The system 10G is shown including a compressor 12 and a condenser 14 disposed outside of the building 15 (i.e., outdoors) and includes an expansion valve 16 and an evaporator 18 disposed inside of the building 15 (indoors).

A first isolation valve 20 is disposed between the evaporator 18 and the compressor 12. A second isolation valve 22 is disposed, for example, outside of the building, and between the condenser 14 and the expansion valve 16. A control module 102 controls the compressor 12 and the isolation valves 20, 22.

The control module 102 receives signals from a pair of pressure sensors and/or a pair of temperature sensors 130A, 130B, that make measurements across (i.e., on opposite sides of) the expansion valve 16. The control module 102 monitors the measurements from the temperature and/or pressure sensors 130A, 130B while the isolation valves 20, 22 and the expansion valve 16 are closed to determine whether a leak is present through the expansion valve. For example, the control module 102 may determine whether a leak is present through the expansion valve when temperature and/or pressure (e.g., across the expansion valve 16) changes by at least a predetermined amount. Because the isolation valves 20 and 22 and the expansion valve 16 should be closed, a leak through the expansion valve 16 may be present when a temperature difference across the expansion valve and/or a pressure difference across the expansion valve measured by the sensors 130A, 130B changes by at least a predetermined amount while the valves 20, 22, and 16 are closed.

Leakage through the expansion valve 16 causes cooling of the refrigerant downstream of the expansion valve 16. When a leak is detected, the control module 102 can turn on a fan that blows air across the evaporator 18 (e.g., fan 100) and/or one or more other mitigation devices. The control module 102 may additionally turn off or lock out any ignition source.

In the example of FIG. 13, positive-sealing isolation valves 20, 22 are used. To verify that the leak is through the expansion valve 16 and not an isolation valve, the control module 102 may perform one or more diagnostics to verify that the isolation valves 20, 22 do not have a leak. The pressure or temperature sensors 130A, 130B are installed to observe the saturation temperature or pressure of the isolated refrigerant in relation to the ambient temperature or pressure while in the non-operating period.

Figure 14:
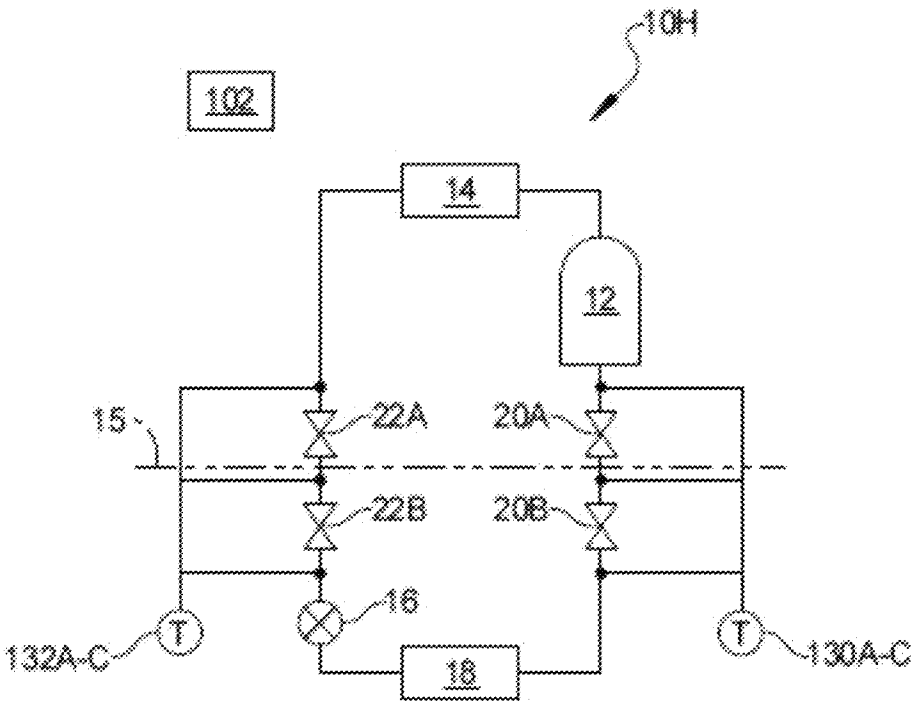
FIG. 14 is a functional block diagram of an example refrigeration system including redundant isolation valves and temperature or pressure sensors.

With reference to FIG. 14, a functional block diagram of an example refrigeration (e.g., air conditioning) system 10H is provided. The system 10H is shown including a compressor 12 and a condenser 14 disposed outside of the building 15 (i.e., outdoors) and includes an expansion valve 16 and an evaporator 18 disposed inside of the building 15 (i.e., indoors).

A first pair of isolation valves 20A, 20B are disposed between the evaporator 18 and the compressor 12 with one isolation valve 20A on the outdoor side and one isolation valve 20B on the indoor side. A second pair of redundant isolation valves 22A, 22B are disposed between the condenser 14 and the expansion valve 16 with one isolation valve 22A on the outdoor side and one isolation valve 22B on the indoor side.

A control module 102 controls the compressor 12 and the isolation valves 20A, 20B, 22A, 22B. The control module 102 receives measurements from temperature sensors 130A, 130B, 130C. The temperature sensor 130A is disposed (and measures) upstream of the isolation valves 20A, 20B, between the evaporator 18 and the isolation valve 20B. The temperature sensor 130B is disposed (and measures) between the isolation valves 20A, 20B. The temperature sensor 130C is disposed (and measures) downstream of the isolation valves 20A, 20B, between the isolation valve 20A and the compressor 12. The control module 102 also receives measurements from temperature and/or pressure sensors 132A, 132B, 132C. The sensor 132A is disposed (and measures) upstream of the isolation valves 22A, 22B, between the condenser 14 and the isolation valve 22A. The sensor 132B is disposed (and measures) between the isolation valves 22A, 22B. The sensor 132C is disposed (and measures) downstream of the isolation valves 22A, 22B, between the isolation valve 22A and the evaporator 18.

The control module 102 monitors the measurements from the sensors 130A, 130B, 130C, 132A, 132B, 132C with the isolation valves 20, 22 and the expansion valve 16 all closed to determine whether a leak is present. The control module 102 may determine that a leak is present when one or more measurements or differences between two or more measurements change by at least a predetermined value. If so, the control module 102 may determine that a leak is present.

When a leak is detected, the control module 102 may turn on a fan (e.g., the fan 100) and/or one or more other mitigation devices. This may dissipate or dilute any leaked refrigerant. The redundant isolation valves 20B and 22B may be used to provide additional protection to isolate refrigerant outside of the building.

According to an additional method of the present disclosure, a pump out (removal) procedure can be performed at the end of a cooling season (e.g., at a predetermined date and time, such as October 1 in the northern hemisphere). This may allow for low levels of leakage through the isolation valves back into the indoor coil of an HVAC system with charge isolation. Additionally or alternatively, a pump out procedure can be performed when the refrigeration system has continuously been off for a predetermined number of days (e.g., 14 days or another suitable number of days). A standard maximum leakage rate for the isolation valves when closed may be a predetermined value. The control module may track the period since a last pump down while the system has continuously been off and perform another pump down to prevent the indoor charge amount from exceeding the predetermined amount (M1) based on the standard maximum leakage rate.

Figure 15:
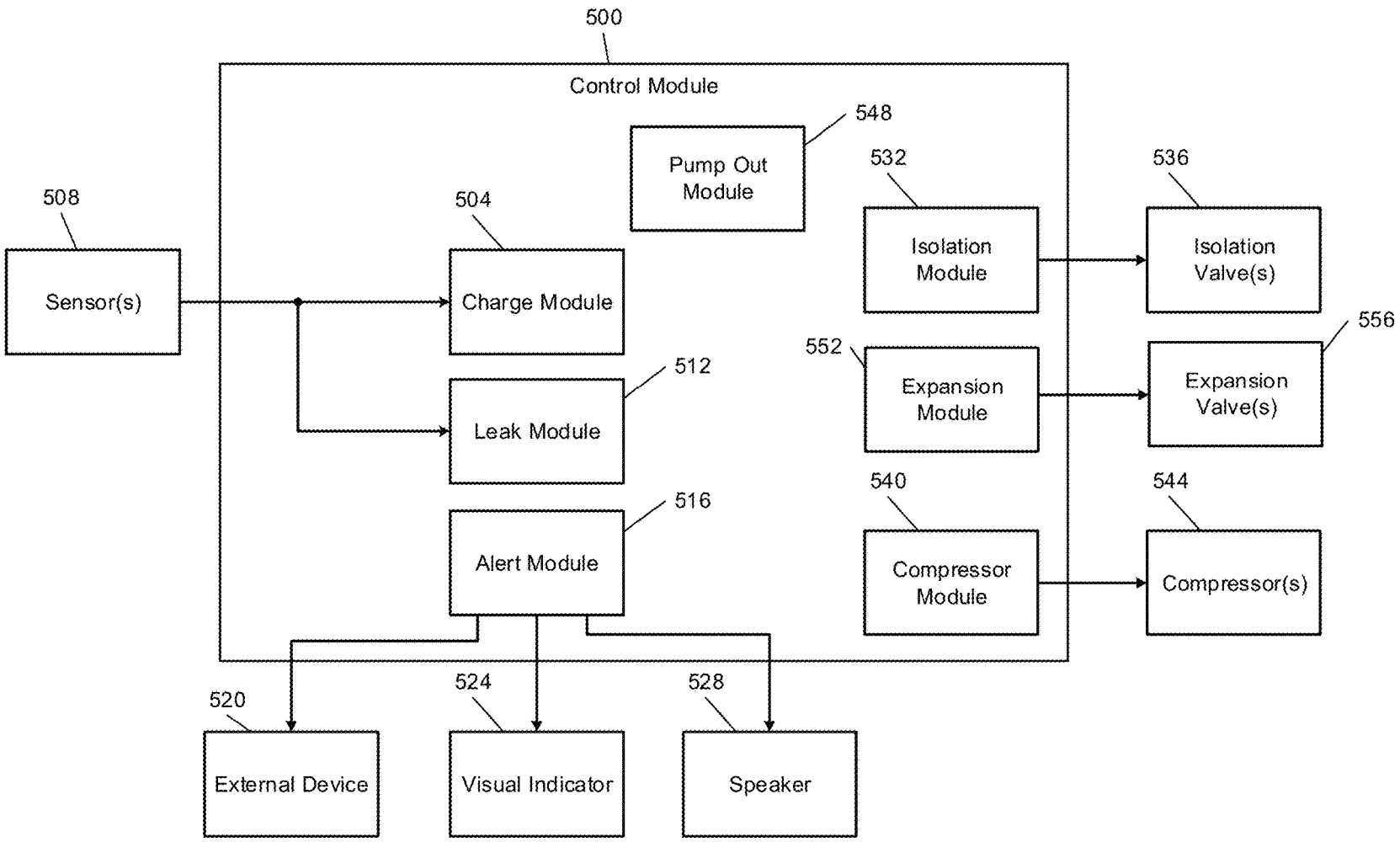
FIG. 15 is a functional block diagram of an example control system including a control module.

FIG. 15 is a functional block diagram of an example control system including a control module 500, such as one or more of the control modules discussed above. A charge module 504 determines the indoor charge amount, the outdoor charge amount, and/or the total charge amount, such as described above. The charge module 504 determines the amounts based on measurements from one or more sensors 508, as described above.

A leak module 512 diagnoses whether a leak is present, such as discussed above. The leak module 512 may determine whether a leak is present based on measurements from one or more sensors 508, the indoor charge amount, the outdoor charge amount, and/or the total charge amount, such as discussed above. An alert module 516 generates one or more indicators when a leak is present. For example, the alert module 516 may transmit an indicator to one or more external devices 520, generate one or more visual indicators 524 (e.g., turn on one or more lights, display information on one or more displays, etc.), generate one or more audible indicators, such as via one or more speakers 528.

An isolation module 532 controls opening and closing of isolation valve(s) 536 of the refrigeration system, as described above. A compressor module 540 controls operation (e.g., ON/OFF) of one or more compressors 544, as discussed above. The compressor module 540 may also control speed, capacity, etc. of one or more of the compressors 544. A pump out module 548 selectively performs pump outs, such as described above. An expansion module 552 may control opening and closing of one or more expansion valves 556, such as described above. The modules may communicate and cooperate to perform respective operations described above. For example, the isolation, expansion, and compressor modules 532, 552, and 540 may control the isolation valve(s), expansion valve(s), and compressor(s) as described above to determine whether a leak is present, for a pump out, etc.

The present disclosure further provides a method to control the operation of the elements including but not limited to the compressor 12, the expansion device 16, flow devices, or other components of a vapor compression system based on the operation of the isolation valves 20, 22 and a calculation of refrigerant charge where the thermostat or other control methods can be overridden (i.e. system shutdown) based on the charge calculation representing a leak is present.

The present disclosure also provides for a control module that controls the isolation valve sequence, the operation of elements including but not limited to the compressor 12, the expansion device 16, flow devices, or other components of a vapor compression system, and processes sensor inputs to calculate the system refrigerant charge. The control module has the ability to communicate (send and receive) with logging, diagnostics, monitoring, programming, debugging, database services or other devices. The processing can be performed locally to the condensing unit, locally to the furnace unit, remotely to the other processors in the HVAC/refrigeration system, and/or other remote processors.

Figure 16:
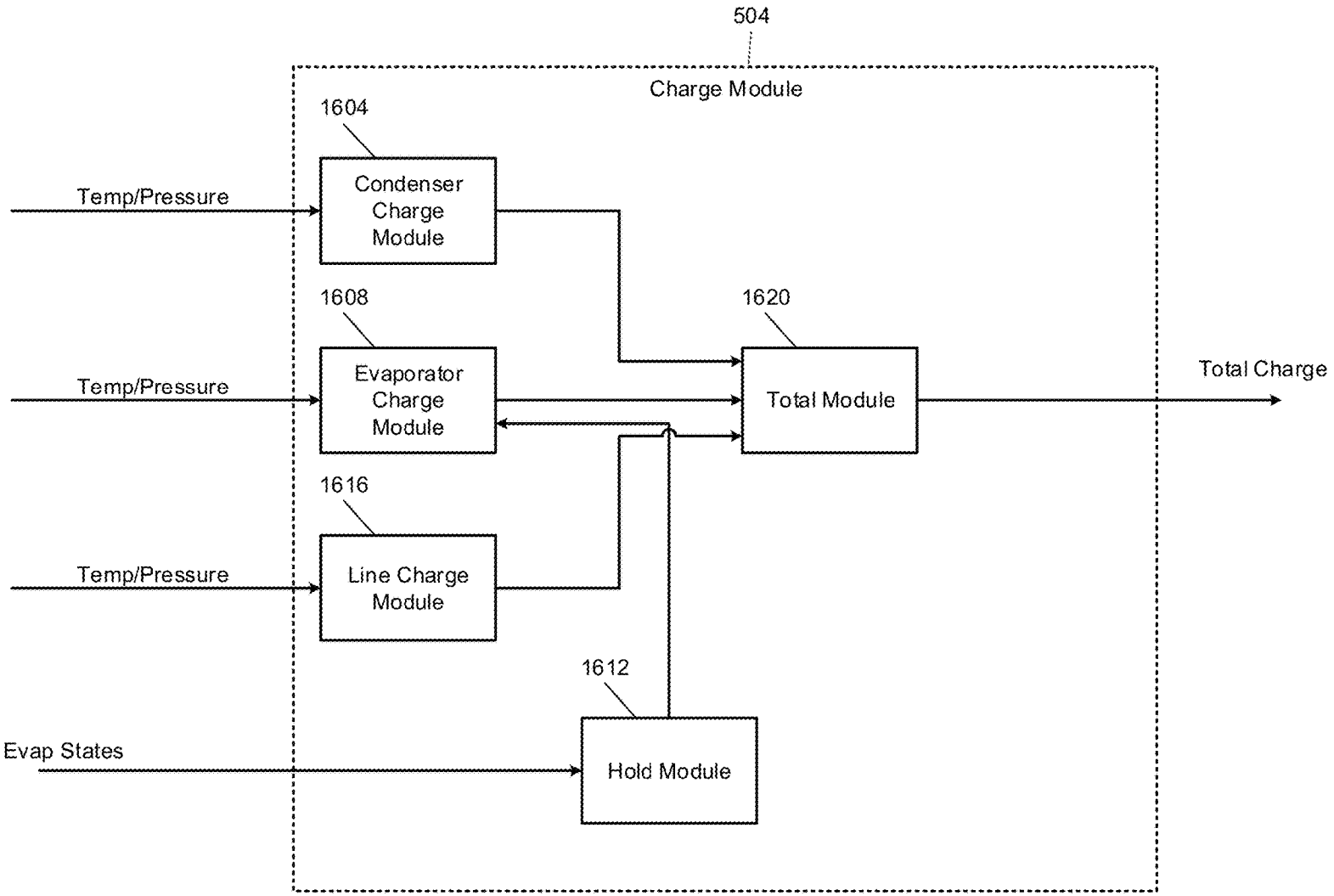
FIG. 16 a functional block diagram of an example implementation of a charge module.

FIG. 16 is a functional block diagram of an example implementation of the charge module 504. As discussed above in the example of FIG. 2, the refrigeration system may include multiple evaporators (e.g., 38A-D) and multiple compressors (e.g., 32A-C). The refrigeration system may be of an HVAC system, a cooler, a freezer, a heat pump system, or another type of refrigeration system.

The charge module 504 is configured to determine a total refrigerant charge (also referred to as total charge amount) within the refrigeration system (including multiple evaporators). The refrigeration system may also include multiple condensers.

One or more actions may be taken based on the total refrigerant charge, such as described above. For example, the leak module 512 may diagnose a leak in the refrigeration system when the total refrigerant charge is less than a predetermined value or decreases by at least a predetermined amount.

The charge module 504 includes a condenser charge module 1604 that determines a total condenser refrigerant charge of the condenser(s). The total condenser refrigerant charge is a total amount of refrigerant presently within (only) the condenser(s). The condenser charge module 1604 determines a condenser refrigerant charge of each condenser of the refrigerant system and sets the total condenser refrigerant charge to or based on a sum of the condenser refrigerant charges of the individual condensers. The condenser charge module 1604 determines the condenser refrigerant charge(s) of the condenser(s), respectively, as discussed further below, based on temperatures and pressures, such as temperatures and pressures at outlets of the condenser(s) measured using temperature and pressure sensors.

The charge module 504 includes an evaporator charge module 1608 that determines a total evaporator refrigerant charge of the evaporators. The total evaporator refrigerant charge is a total amount of refrigerant presently within (only) the evaporators. The evaporator charge module 1608 determines an evaporator refrigerant charge of each evaporator of the refrigerant system and sets the total evaporator refrigerant charge to or based on a sum of the evaporator refrigerant charges of the individual evaporators. The evaporator charge module 1608 determines the evaporator refrigerant charges of the evaporators, respectively, as discussed further below, based on temperatures and pressures, such as temperatures and pressures at outlets of the evaporators measured using temperature and pressure sensors.

At some times, one or more of the evaporators may be isolated such that refrigerant flow does not flow into or out of those one or more evaporators. An evaporator is isolated by closing the isolation valves of that evaporator. The isolation module 532 may close the isolation valves of an evaporator to isolate an evaporator, for example, when an air temperature of a space cooled by that evaporator is less than a setpoint temperature. The setpoint temperature may be variable, such as via a thermostat. In various implementations, two or more evaporators may cool the same space. In various implementations, each evaporator cools one specific space.

A hold module 1612 receives evaporator states that indicate whether the evaporators, respectively, are presently isolated or not. When an evaporator is isolated, the hold module 1612 prompts the evaporator charge module 1608 to maintain the evaporator refrigerant charge of that evaporator constant until the evaporator next is not isolated. When an evaporator is not isolated, the hold module 1612 allows the evaporator charge module 1608 to update the evaporator refrigerant charge of that evaporator, such as every predetermined period.

The charge module 504 includes a line charge module 1616 that determines a total line refrigerant charge of the (refrigerant) lines connecting components of the refrigeration system. This includes refrigerant lines connected between compressors and condensers, refrigerant lines connected between condensers and expansion valves, refrigerant lines connected between expansion valves and evaporators, refrigerant lines connected between evaporators and compressors, and other refrigerant lines of the system. In various implementations, one or more other devices (e.g., isolation valves) may be connected between components. The total line refrigerant charge is a total amount of refrigerant presently within (only) the refrigerant lines.

The line charge module 1616 determines a line refrigerant charge of each (refrigerant) line of the refrigerant system and sets the total line refrigerant charge to or based on a sum of the line refrigerant charges of the individual lines. The line charge module 1616 determines the line refrigerant charges of the lines, respectively, as discussed further below, based on temperatures and pressures, such as temperatures and pressures at outlets of the evaporators measured using temperature and pressure sensors. The line charge module 1616 determines a total line refrigerant charge based on the line refrigerant charges. For example, the line charge module 1616 may set the total line refrigerant charge (amount, such as mass) based on or equal to a sum of the line refrigerant charges.

Figure 17:
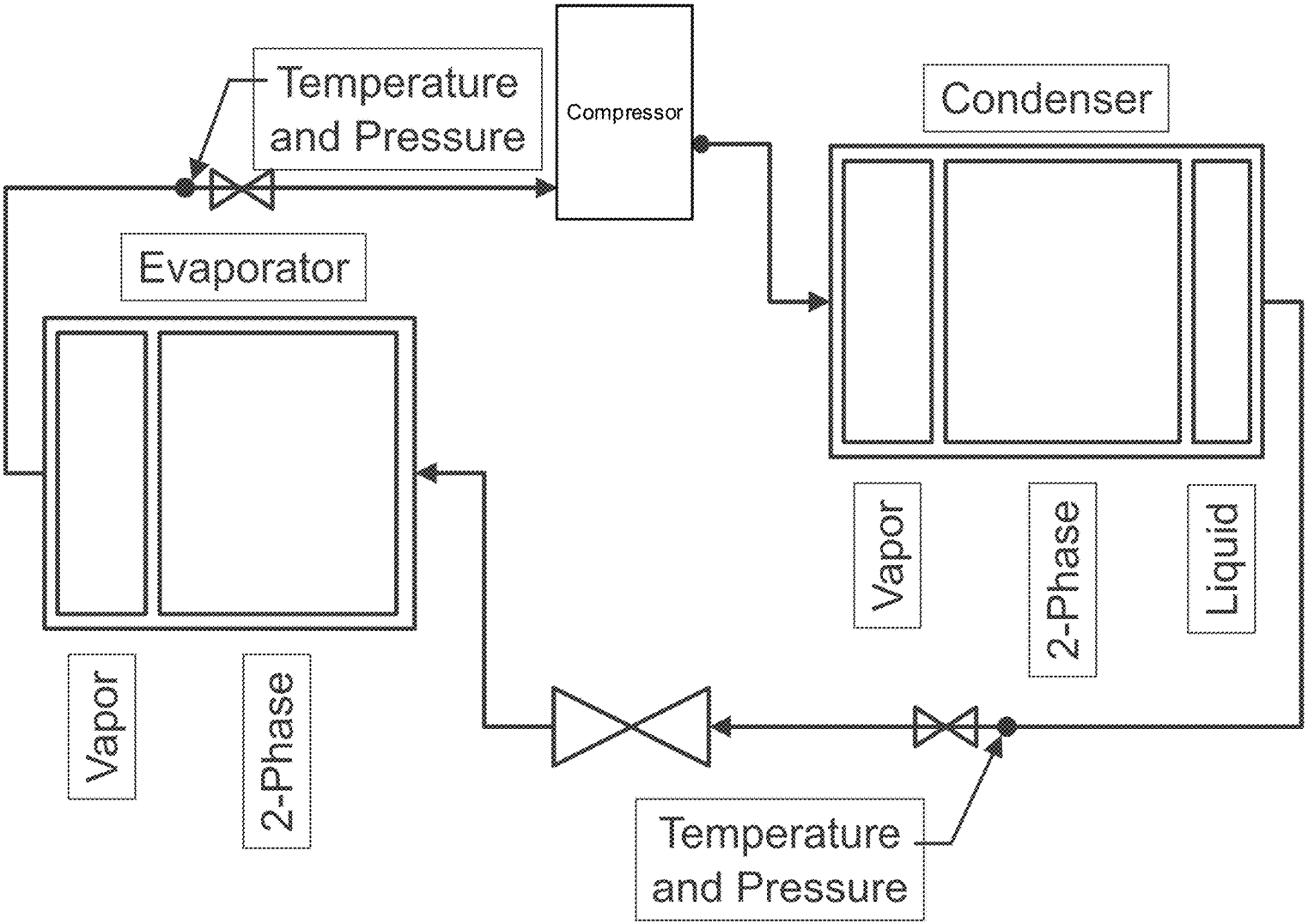
FIG. 17 includes a functional block diagram including an example portion of a refrigeration system.

FIG. 17 includes a functional block diagram including an example implementation of a portion of a refrigeration system. As discussed above, the refrigeration system includes multiple evaporators and may include multiple condensers and/or compressors. The example of FIG. 17 includes only one compressor, evaporator, and condenser for simplicity.

Each condenser may include a vapor refrigerant portion, a two-phase refrigerant portion, and a liquid portion. Refrigerant is present in vapor form in the vapor refrigerant portion. Both vapor and liquid refrigerant is present in the two-phase refrigerant portion. Liquid refrigerant is present in the liquid refrigerant portion.

Similarly, each evaporator may include a vapor refrigerant portion and a two-phase refrigerant portion. Refrigerant is present in vapor form in the vapor refrigerant portion. Both vapor and liquid refrigerant is present in the two-phase refrigerant portion.

Temperature and pressure near the outlet of each evaporator are measured using temperature and pressure sensors, respectively. Temperature and pressure near the outlet of each condenser are measured using temperature and pressure sensors, respectively.

Referring back to FIG. 16, the line charge module 1616 determines the line refrigerant charge (amount, such as mass) of each liquid line between a condenser and an evaporator based on a density of the liquid refrigerant in that liquid line, pi ($\pi$), an inner diameter of that liquid line, and a length of that liquid line. The line charge module 1616 may determine the line charge of a liquid line using one of an equation and a lookup table that relates density, pi, inner diameters, and lengths to amounts of refrigerant. For example, the line charge module 1616 may determine the line charge of a liquid line using the equation:

$$\text{mass}=d*pi*ID^2*L/4,$$

where mass is the amount (mass) of refrigerant in the liquid line, d is the density of liquid in the liquid line, pi is the value $\pi$, ID is the inner diameter of the liquid line, and L is the length of the liquid line.

The line charge module 1616 may determine the density of the liquid in a liquid line, for example, based on the temperature and pressure of the refrigerant in the liquid line measured using temperature and pressure sensors. The line charge module 1616 may determine the density, for example, using one of an equation and a lookup table that relates temperatures and pressures to density of refrigerant. The inner diameter and the length of each liquid line may be stored in memory, such as in response to user input from an installer of the refrigeration system. In various implementations, the line charge module 1616 may learn the inner diameter and the length of the liquid lines. For example, the line charge module 1616 may close one or more isolation valves to pump refrigerant out of that liquid line and monitor the volume of refrigerant pumped out of that liquid line and set the $ID^2*L$ equal to the determined volume.

The line charge module 1616 determines the line refrigerant charge (amount, such as mass) of each two phase line between an expansion valve and an evaporator based on a density of the liquid refrigerant in that two phase line, pi ($\pi$), an inner diameter of that two phase line, and a length of that two phase line. The line charge module 1616 may determine the line refrigerant charge of a two phase line using one of an equation and a lookup table that relates density, pi, inner diameters, and lengths to amounts of refrigerant. For example, the line charge module 1616 may determine the line refrigerant charge of a two phase line using the equation:

$$\text{mass}=d*pi*ID^2*L/4,$$

where mass is the amount (mass) of refrigerant in the two phase line, d is the density of liquid in the two phase line, pi is the value π, ID is the inner diameter of the two phase line, and length is the length of the two phase line.

The line charge module 1616 may determine the density of the refrigerant in a two phase line, for example, based on the temperature and pressure of the refrigerant in the two phase line measured using temperature and pressure sensors. The line charge module 1616 may determine the density, for example, using one of an equation and a lookup table that relates temperatures and pressures to density of refrigerant. The inner diameter and the length of each two phase line may be stored in memory, such as in response to user input from an installer of the refrigeration system. In various implementations, the line charge module 1616 may learn the inner diameter and the length of the two phase lines. For example, the line charge module 1616 may close one or more isolation valves to pump refrigerant out of that two phase line and monitor the volume of refrigerant pumped out of that two phase line and set the $ID^2*L$ equal to the determined volume.

The line charge module 1616 determines the line refrigerant charge (amount, such as mass) of each discharge (e.g., gas/vapor) line between a compressor and a condenser based on a density of the refrigerant in that discharge line, pi (π), an inner diameter of that discharge line, and a length of that discharge line. The line charge module 1616 may determine the line refrigerant charge of a discharge line using one of an equation and a lookup table that relates density, pi, inner diameters, and lengths to amounts of refrigerant. For example, the line charge module 1616 may determine the line refrigerant charge of a discharge line using the equation:

$$mass=d*pi*ID^2*L/4,$$

where mass is the amount (mass) of refrigerant in the discharge line, d is the density of liquid in the discharge line, pi is the value π, ID is the inner diameter of the discharge line, and L is the length of the line.

The line charge module 1616 may determine the density of the refrigerant in a discharge line, for example, based on the temperature and pressure of the refrigerant in the discharge line measured using temperature and pressure sensors. The line charge module 1616 may determine the density, for example, using one of an equation and a lookup table that relates temperatures and pressures to density of refrigerant. The inner diameter and the length of each discharge line may be stored in memory, such as in response to user input from an installer of the refrigeration system. In various implementations, the line charge module 1616 may learn the inner diameter and the length of the discharge lines. For example, the line charge module 1616 may close one or more isolation valves to pump refrigerant out of that discharge line and monitor the volume of refrigerant pumped out of that discharge line and set the $ID^2*L$ equal to the determined volume. In various implementations, the line refrigerant charge of one or more discharge lines may be negligible (e.g., when the expansion valve is disposed near the evaporator) and may therefore be set to zero.

The line charge module 1616 determines the line refrigerant charge (amount, such as mass) of each suction (e.g., gas/vapor) line between an evaporator and a compressor based on a density of the refrigerant in that suction line, pi (π), an inner diameter of that suction line, and a length of that suction line. The line charge module 1616 may determine the line refrigerant charge of a suction line using one of an equation and a lookup table that relates density, pi, inner diameters, and lengths to amounts of refrigerant. For example, the line charge module 1616 may determine the line refrigerant charge of a suction line using the equation:

$$mass=d*pi*ID^2*L/4,$$

where mass is the amount (mass) of refrigerant in the suction line, d is the density of liquid in the suction line, pi is the value π, ID is the inner diameter of the suction line, and L is the length of the suction line.

The line charge module 1616 may determine the density of the refrigerant in a suction line, for example, based on the temperature and pressure of the refrigerant in the discharge line measured using temperature and pressure sensors. The line charge module 1616 may determine the density, for example, using one of an equation and a lookup table that relates temperatures and pressures to density of refrigerant. The inner diameter and the length of each suction line may be stored in memory, such as in response to user input from an installer of the refrigeration system. In various implementations, the line charge module 1616 may learn the inner diameter and the length of the suction lines. For example, the line charge module 1616 may close one or more isolation valves to pump refrigerant out of that suction line and monitor the volume of refrigerant pumped out of that suction line and set the $ID^2*L$ equal to the determined volume.

As discussed above, each condenser includes a vapor portion, a two-phase portion, and a liquid portion. The condenser charge module 1604 determines the condenser refrigerant charge of a condenser based on a vapor refrigerant charge (amount, such as mass) of the vapor portion of the condenser, a two-phase refrigerant charge (amount, such as mass) of the two-phase portion of the condenser, and a liquid refrigerant charge (amount, such as mass) of the liquid portion of the condenser. The condenser charge module 1604 may set the condenser refrigerant charge (amount, such as mass) for a condenser based on or equal to a sum of the vapor refrigerant charge, the two-phase refrigerant charge, and the liquid refrigerant charge of the condenser. The condenser charge module 1604 determines the condenser refrigerant charge for each condenser. The condenser charge module 1604 sets the total condenser refrigerant charge (amount, such as mass) based on or equal to a sum of the condenser refrigerant charge(s) of the condenser(s).

The condenser charge module 1604 may determine the vapor refrigerant charge, the two-phase refrigerant charge, and the liquid refrigerant charge of the condenser as follows. The condenser charge module 1604 may determine an enthalpy of the vapor portion, an enthalpy of the two-phase portion, and an enthalpy of the liquid portion.

The condenser charge module 1604 may determine the enthalpy of the vapor portion based on the pressures and temperatures measured across the condenser, such as shown in the example of FIG. 17. The condenser charge module 1604 may determine the enthalpy of the vapor portion using one of a lookup table and an equation that relates the pressures and temperatures to enthalpy of the vapor portion.

The condenser charge module 1604 may determine the enthalpy of the two-phase portion based on the pressures and temperatures measured across the condenser, such as shown in the example of FIG. 17. The condenser charge module 1604 may determine the enthalpy of the two-phase portion using one of a lookup table and an equation that relates the pressures and temperatures to enthalpy of the two-phase portion.

The condenser charge module 1604 may determine the enthalpy of the liquid portion based on the pressures and temperatures measured across the condenser, such as shown in the example of FIG. 17. The condenser charge module

1604 may determine the enthalpy of the liquid portion using one of a lookup table and an equation that relates the pressures and temperatures to enthalpy of the liquid portion.

The condenser charge module 1604 may determine a percentage of a total volume of the condenser that includes vapor refrigerant, a percentage of the total volume of the condenser that includes two-phase refrigerant, and a percentage of the total volume of the condenser that includes liquid refrigerant. The condenser charge module 1604 may determine the percentages based on (a) a difference between the enthalpy of the vapor portion and the enthalpy of the two-phase portion and (b) a difference between the enthalpy of the two-phase portion and the liquid portion. The condenser charge module 1604 may determine the percentages using one of a lookup table and an equation that relates these differences to the percentages. The lookup table or equation may be calibrated based on the assumption of a predetermined ratio for overall heat transfer coefficient between each portion/phase. The sum of the percentages may be equal to 100 percent such that the volume of the vapor portion plus the volume of the liquid portion plus the volume of the two-phase portion is equal to the total volume of the condenser.

The condenser charge module 1604 may determine the vapor refrigerant charge of a condenser based on a density of refrigerant within the vapor portion of vapor portion of the condenser, the total volume of the condenser, and the percentage of the total volume that includes vapor refrigerant (the vapor portion). The condenser charge module 1604 may determine the vapor refrigerant charge using a lookup table or an equation that relates densities, the total volume, and percentages to vapor refrigerant charges. For example, the condenser charge module 1604 may set the vapor refrigerant charge based on or to mass=density*TV*% where mass is the vapor refrigerant charge (mass), density is the density of the vapor refrigerant in the vapor portion, TV is the total volume of the condenser, and % is the percentage of the total volume that is the vapor portion. The total volume of the condenser may be a predetermined value or determined. The condenser charge module 1604 may determine the density of the vapor refrigerant, for example, based on the pressures and temperatures, such as illustrated in the example of FIG. 17. The condenser charge module may determine the density of vapor refrigerant using one of an equation and a lookup table that relates the pressures and temperatures to vapor refrigerant densities.

The condenser charge module 1604 may determine the liquid refrigerant charge of a condenser based on a density of refrigerant within the liquid portion of the condenser, the total volume of the condenser, and the percentage of the total volume that includes liquid refrigerant (the liquid portion). The condenser charge module 1604 may determine the liquid refrigerant charge using a lookup table or an equation that relates densities, the total volume, and percentages to liquid refrigerant charges. For example, the condenser charge module 1604 may set liquid refrigerant charge based on or to mass=density*TV*% where mass is the liquid refrigerant charge (mass), density is the density of the liquid refrigerant in the liquid portion, TV is the total volume of the condenser, and % is the percentage of the total volume that is the liquid portion. The density of the liquid refrigerant may be a predetermined value, or the condenser charge module 1604 may determine the density of the liquid refrigerant, for example, based on the pressures and temperatures, such as illustrated in the example of FIG. 17. The condenser charge module may determine the density of liquid refrigerant using one of an equation and a lookup table that relates the pressures and temperatures to liquid refrigerant densities.

The condenser charge module 1604 may determine the two-phase refrigerant charge of a condenser based on a density of refrigerant within the two-phase portion of the condenser, the total volume of the condenser, and the percentage of the total volume that includes two-phase refrigerant (the two-phase portion). The condenser charge module 1604 may determine the two-phase refrigerant charge using a lookup table or an equation that relates densities, the total volume, and percentages to two-phase refrigerant charges. For example, the condenser charge module 1604 may set the two-phase refrigerant charge based on or to mass=density*TV*% where mass is the two-phase refrigerant charge (mass), density is the density of the two-phase refrigerant in the vapor portion, TV is the total volume of the condenser, and % is the percentage of the total volume that is the two-phase portion.

The density of the two-phase refrigerant may be determined by the condenser charge module 1604 based on a specific volume of the two-phase portion. The condenser charge module 1604 may determine the density, for example, based on or equal to an inverse of the specific volume of the two-phase portion. The condenser charge module may determine the specific volume of the two-phase portion using the equation $$\rho_{ave} = \int_{vap}^{liq} \frac{1}{spec\ \text{volume}} dv = \frac{\left[\ln\left(\frac{1}{v_{liq}}\right) - \ln\left(\frac{1}{v_{vap}}\right)\right]}{(v_{vap} - v_{liq})},$$

where $\rho_{ave}$ is the density of the two-phase portion, $v_{liq}$ is a specific volume of the liquid portion of the condenser, $v_{vap}$ is a specific volume of the vapor portion of the condenser, and In denotes the natural log function. The condenser charge module 1604 may determine the specific volumes of the liquid and vapor portions, for example, based on the pressures and temperatures (e.g., using lookup tables or equations), such as the pressures and temperatures illustrated in the example of FIG. 17.

As discussed above, each evaporator that is not isolated includes a vapor portion and a two-phase portion. The evaporator charge module 1608 determines the evaporator refrigerant charge of an evaporator based on a vapor refrigerant charge (amount, such as mass) of the vapor portion of the evaporator and a two-phase refrigerant charge (amount, such as mass) of the two-phase portion of the evaporator. The evaporator charge module 1608 may set the evaporator refrigerant charge (amount, such as mass) for an evaporator based on or equal to a sum of the vapor refrigerant charge and the two-phase refrigerant charge.

The evaporator charge module 1608 determines the evaporator refrigerant charge for each evaporator. As discussed above, the evaporator charge module 1608 maintains constant the evaporator refrigerant charge(s) of evaporator(s) that is/are isolated. The evaporator charge module 1608 sets the total evaporator refrigerant charge (amount, such as mass) based on or equal to a sum of the evaporator refrigerant charges of the evaporators, respectively.

The evaporator charge module 1608 may determine the vapor refrigerant charge and the two-phase refrigerant charge of each non-isolated evaporator as follows. The evaporator charge module 1608 may determine an enthalpy of the vapor portion and an enthalpy of the two-phase portion.

The evaporator charge module 1608 may determine the enthalpy of the vapor portion based on the pressures and temperatures measured across the evaporator, such as shown in the example of FIG. 17. The evaporator charge module 1608 may determine the enthalpy of the vapor portion using one of a lookup table and an equation that relates the pressures and temperatures to enthalpy of the vapor portion.

The evaporator charge module 1608 may determine the enthalpy of the two-phase portion based on the pressures and temperatures measured across the evaporator, such as shown in the example of FIG. 17. The evaporator charge module 1608 may determine the enthalpy of the two-phase portion using one of a lookup table and an equation that relates the pressures and temperatures to enthalpy of the two-phase portion.

The evaporator charge module 1608 may determine a percentage of a total volume of the evaporator that includes vapor refrigerant and a percentage of the total volume of the evaporator that includes two-phase refrigerant. The evaporator charge module 1608 may determine the percentages based on a difference between the enthalpy of the vapor portion and the enthalpy of the two-phase portion. The evaporator charge module 1608 may determine the percentages using one of a lookup table and an equation that relates the difference to the percentages. The lookup table or equation may be calibrated based on the assumption of a predetermined ratio for overall heat transfer coefficient between each portion/phase. The sum of the percentages may be equal to 100 percent such that the volume of the vapor portion plus the volume of the two-phase portion is equal to the total volume of the evaporator.

The evaporator charge module 1608 may determine the vapor refrigerant charge of an evaporator based on evaporator a density of refrigerant within the vapor portion of vapor portion of the evaporator, the total volume of the evaporator, and the percentage of the total volume that includes vapor refrigerant (the vapor portion). The evaporator charge module 1608 may determine the vapor refrigerant charge using a lookup table or an equation that relates densities, the total volume, and percentages to vapor refrigerant charges. For example, the evaporator charge module 1608 may set the vapor refrigerant charge based on or to mass=density*TV*% where mass is the vapor refrigerant charge (mass), density is the density of the vapor refrigerant in the vapor portion, TV is the total volume of the condenser, and % is the percentage of the total volume that is the vapor portion. The total volume of the evaporator may be a predetermined value or determined, such as via one or more pump outs of the evaporator. The evaporator charge module 1608 may determine the density of the vapor refrigerant, for example, based on the pressures and temperatures, such as illustrated in the example of FIG. 17. The evaporator charge module 1608 may determine the density of vapor refrigerant using one of an equation and a lookup table that relates the pressures and temperatures to vapor refrigerant densities.

The evaporator charge module 1608 may determine the two-phase refrigerant charge of an evaporator based on a density of refrigerant within the two-phase portion of the evaporator, the total volume of the evaporator, and the percentage of the total volume that includes two-phase refrigerant (the two-phase portion). The evaporator charge module 1608 may determine the two-phase refrigerant charge using a lookup table or an equation that relates densities, the total volume, and percentages to two-phase refrigerant charges. For example, the evaporator charge module 1608 may set the two-phase refrigerant charge based on or to mass=density*TV*% where mass is the two-phase refrigerant charge (mass), density is the density of the two-phase refrigerant in the vapor portion, TV is the total volume of the evaporator, and % is the percentage of the total volume that is the two-phase portion.

The density of the two-phase refrigerant may be determined by the evaporator charge module 1608 based on a specific volume of the two-phase portion. The evaporator charge module 1608 may determine the density, for example, based on or equal to an inverse of the specific volume of the two-phase portion. The evaporator charge module 1608 may determine the specific volume of the two-phase portion using the equation $$\rho_{ave} = \int_{vap}^{liq} \frac{1}{spec\ \text{volume}} dv = \frac{\left[\ln\left(\frac{1}{v_{inlet}}\right) - \ln\left(\frac{1}{v_{vap}}\right)\right]}{(v_{vap} - v_{inlet})},$$

where $\rho_{ave}$ is the density of the two-phase portion, $v_{inlet}$ is a specific volume of the liquid or two phase refrigerant input to the evaporator, $v_{vap}$ is a specific volume of the vapor portion of the evaporator, and In denotes the natural log function. The evaporator charge module 1608 may determine the specific volumes of the liquid and vapor, for example, based on the pressures and temperatures (e.g., using lookup tables or equations), such as the pressures and temperatures illustrated in the example of FIG. 17.

A total module 1620 determines a total refrigerant charge (amount, such as mass) in the refrigeration system (present) based on the total condenser refrigerant charge, the total evaporator refrigerant charge, and the total line refrigerant charge. The total module 1620 may, for example, set the total refrigerant charge based on or equal to a sum of the total condenser refrigerant charge, the total evaporator refrigerant charge, and the total line refrigerant charge.

One or more actions may be selectively taken based on the total refrigerant charge of the refrigeration system as discussed above. For example, the leak module 512 may indicate that a refrigerant leak is present when the total refrigerant charge is less than a predetermined amount or decreases by at least a predetermined amount. One or more actions may be taken when a leak is indicated, as discussed above. Additionally or alternatively, the alert module 516 may output an alert when the total refrigerant charge is less than the predetermined amount or decreases by at least a predetermined amount.

Figure 18:
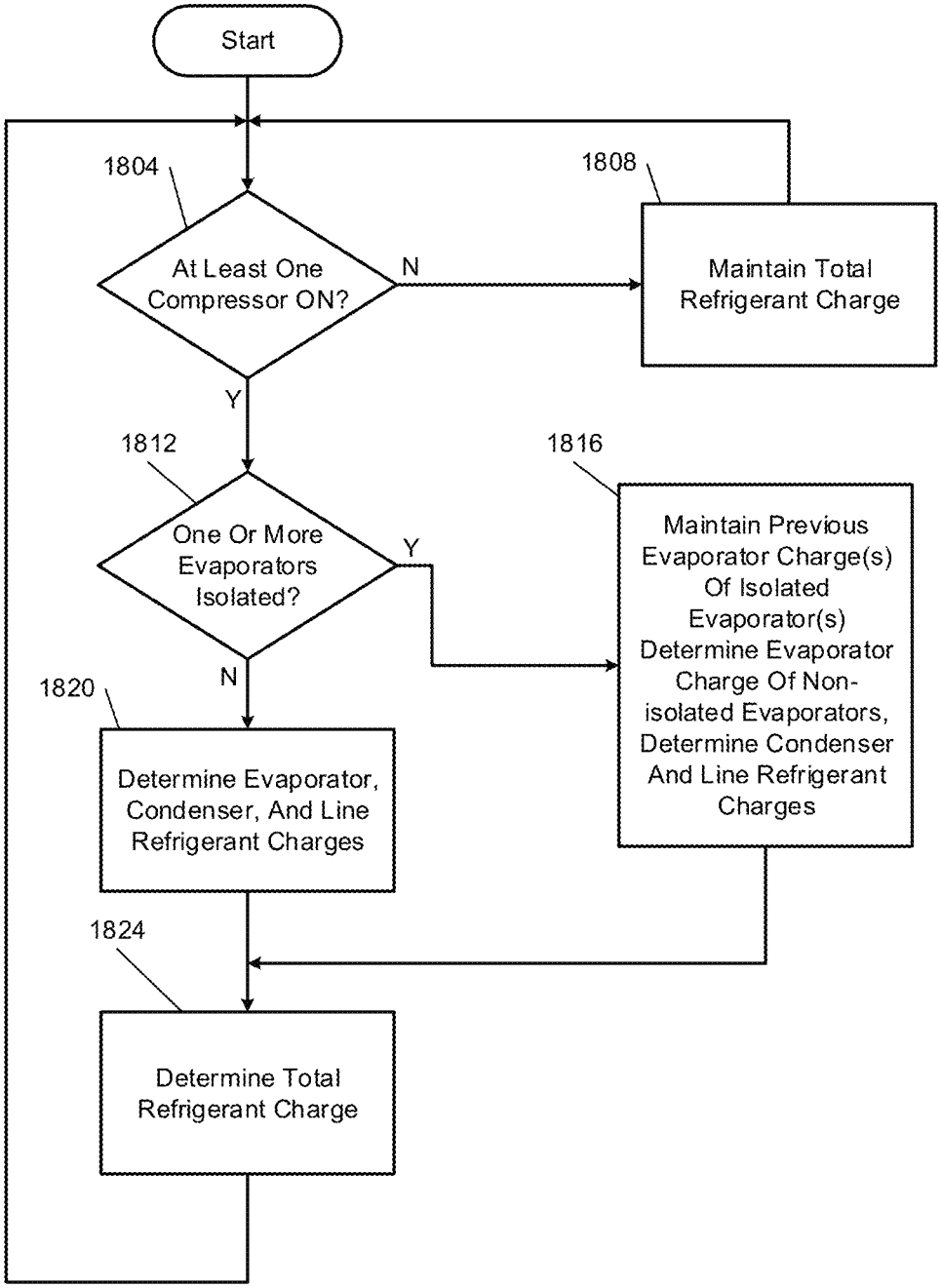
FIG. 18 is a flowchart depicting an example method of determining the total refrigerant charge of a refrigeration system including multiple evaporator.

FIG. 18 is a flowchart depicting an example method of determining the total refrigerant charge of a refrigeration system including multiple evaporators. At 1804, the charge module 504 determines whether one or more compressors of the refrigeration system are ON and pumping refrigerant. If 1804 is true, control continues with 1812. If 1804 is false, control transfers to 1808. At 1808, when no compressors are pumping refrigerant, the total charge module 504 maintains the total refrigerant charge unchanged (keeps the previous value of the total refrigerant charge), and control returns to 1804.

At 1812, when one or more compressors are on and pumping refrigerant, the hold module 1612 determines whether one or more evaporators of the refrigeration system are presently isolated such that no refrigerant is flowing through the one or more evaporators. If 1812 is false, control transfers to 1820. If 1812 is true, control transfers to 1816.

The hold module 1612 generates output to the evaporator charge module 1608 based on the states of the evaporators. The hold module 1612 identifies which of the evaporators are isolated and which of the evaporators are not isolated.

At 1816, when one or more of the evaporators are isolated, the evaporator charge module 1608 maintains constant the evaporator refrigerant charges (keeps the previous evaporator refrigerant charges) of those one or more evaporators. The evaporator charge module 1608 also updates the evaporator refrigerant charges of one or more non-isolated evaporators, as discussed above. This includes determining the vapor refrigerant amount and the two-phase refrigerant amount of each evaporator, as discussed above. The evaporator charge module 1608 sets the total evaporator refrigerant charge based on or equal to a sum of the evaporator refrigerant charges of the evaporators, respectively.

Also at 1816, the condenser charge module 1604 updates the condenser refrigerant charge(s) of the condenser(s), as discussed above. This includes determining the vapor refrigerant amount, the liquid refrigerant amount, and the two-phase refrigerant amount of each condenser, as discussed above. The condenser charge module 1604 sets the total condenser refrigerant charge based on or equal to a sum of the condenser refrigerant charges of the condensers, respectively. Also at 1816, the line charge module 1616 determines the line charges, as discussed above.

At 1820, when none of the evaporators are isolated, the evaporator charge module 1608 also updates the evaporator refrigerant charges of the evaporators, respectively, as discussed above. This includes determining the vapor refrigerant amount and the two-phase refrigerant amount of each evaporator, as discussed above. The evaporator charge module 1608 sets the total evaporator refrigerant charge based on or equal to a sum of the evaporator refrigerant charges of the evaporators, respectively.

Also at 1820, the condenser charge module 1604 updates the condenser refrigerant charge(s) of the condenser(s), as discussed above. This includes determining the vapor refrigerant amount, the liquid refrigerant amount, and the two-phase refrigerant amount of each condenser, as discussed above. The condenser charge module 1604 sets the total condenser refrigerant charge based on or equal to a sum of the condenser refrigerant charges of the condensers, respectively. Also at 1820, the line charge module 1616 determines the line charges, as discussed above. The line charge module 1616 may set the total line refrigerant charge based on or equal to a sum of the (individual) line charges.

At 1824, the total module 1620 determines the total refrigerant charge of the refrigeration system based on the total condenser refrigerant charge, the total evaporator refrigerant charge, and the total line refrigerant charge. For example, the total module 1620 may set the total refrigerant charge based on or equal to a sum of the total condenser refrigerant charge, the total evaporator refrigerant charge, and the total line refrigerant charge. The total refrigerant charge is a total amount of refrigerant within the entire refrigeration system.

Control returns to 1804. 1804 may be started each predetermined period such that the total refrigerant charge and the individual refrigerant charges are updated each predetermined period. The predetermined period may be, for example, approximately 2 minutes or another suitable period.

Figure 19:
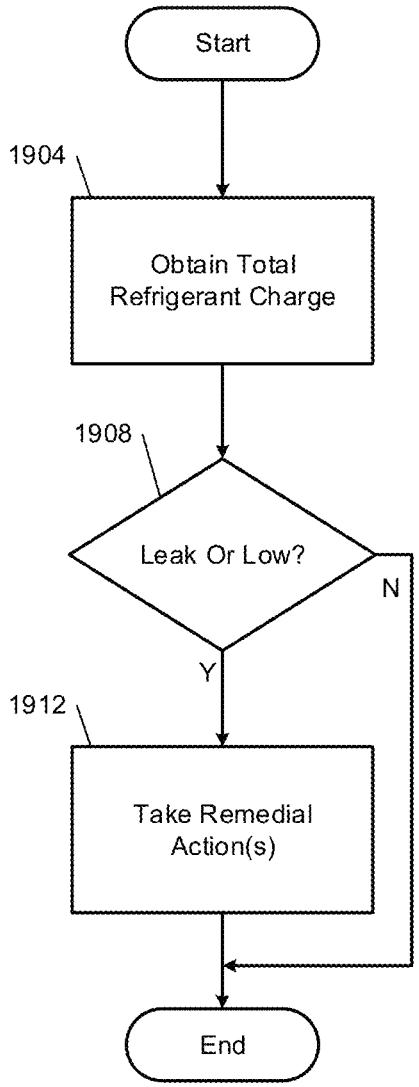
FIG. 19 is a flowchart depicting an example method of controlling operation based on the total refrigerant charge of a refrigeration system including multiple evaporators.

FIG. 19 is a flowchart depicting an example method of controlling operation based on the total refrigerant charge of a refrigeration system including multiple evaporators. At 1904, the control module 500 obtains the most recent value of the total refrigerant charge determined by the charge module 504.

At 1908, the leak module 512 may determine the refrigeration system has a refrigerant leak or a low refrigerant level. For example, the leak module 512 may determine whether the total refrigerant charge is less than a predetermined value (e.g., 2 kilograms or another suitable value) or whether the total refrigerant charge has decreased by at least a predetermined amount (e.g., 0.5 kilograms or another suitable value) over a predetermined period (e.g., 1 day). If 1908 is false, the leak module 512 may indicate that no refrigerant leak is present and no low refrigerant level is present, and control may end. If 1908 is true, one or more actions may be taken at 1912, as described above. For example, the isolation valves may be actuated to pump refrigerant out of the indoor section of the refrigeration system and isolate the refrigerant outside of the building serviced by the refrigeration system when a leak is present. Additionally or alternatively the leak module 512 and/or the alert module 516 may generate one or more outputs indicative of a leak or a low refrigerant level in the refrigeration system, such as discussed above.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A refrigerant monitoring system comprising:

a condenser charge module configured to:

determine a first amount of refrigerant in each condenser of one or more condensers of a refrigeration system;

determine a total condenser amount of refrigerant based on the one or more first amounts;

an evaporator charge module configured to:

determine a second amount of refrigerant in each evaporator of two or more evaporators of the refrigeration system; and determine a total evaporator amount of refrigerant based on the two or more second amounts;

a line charge module configured to:

determine a third amount of refrigerant in each refrigerant line of multiple refrigerant lines of the refrigeration system; and determine a total line amount of refrigerant based on the multiple third amounts; and a total module configured to determine a total amount of refrigerant in the refrigeration system based on the total condenser amount, the total evaporator amount, and the total line amount, wherein the evaporator charge module is configured to:

determine the second amount of refrigerant in one of the two or more evaporators based on:

a fourth amount of vapor refrigerant in the one of the two or more evaporators;

a fifth amount of two-phase refrigerant in the one of the two or more evaporators determine the fourth amount of vapor refrigerant in the one of the two or more evaporators based on a first enthalpy of the vapor refrigerant;

determine the fifth amount of two-phase refrigerant in the one of the two or more evaporators based on a second enthalpy of the two-phase refrigerant;

determine a difference between the first and second enthalpies;

determine a first percentage of a total volume of the one of the two or more evaporators including vapor refrigerant based on the difference between the first and second enthalpies;

determine a second percentage of the total volume of the one of the two or more evaporators including vapor refrigerant based on the difference between the first and second enthalpies;

determine the fourth amount based on the first percentage, a first density of vapor refrigerant, and the total volume; and determine the fifth amount based on the first percentage, a second density of two-phase refrigerant, and the total volume.

2. The refrigerant monitoring system of claim 1 wherein the condenser charge module is configured to determine the first amount of refrigerant in one of the one or more condensers based on:

a sixth amount of vapor refrigerant in the one of the one or more condensers;

a seventh amount of two-phase refrigerant in the one of the one or more condensers; and an eighth amount of liquid refrigerant in the one of the one or more condensers.

3. The refrigerant monitoring system of claim 2 wherein the condenser charge module is configured to determine the first amount of refrigerant in the one of the one or more condensers based on the sixth amount plus the seventh amount plus the eighth amount.

4. The refrigerant monitoring system of claim 1 wherein the condenser charge module is configured to set the total condenser amount based on a sum of the one or more first amounts.

5. The refrigerant monitoring system of claim 1 wherein the evaporator charge module is configured to determine the first amount of refrigerant in the one of the one or more evaporators based on the fourth amount plus the fifth amount.

6. The refrigerant monitoring system of claim 1 wherein the evaporator charge module is configured to set the total evaporator amount based on a sum of the two or more second amounts.

7. The refrigerant monitoring system of claim 1 wherein the line charge module is configured to set the total line amount based on a sum of the multiple third amounts.

8. The refrigerant monitoring system of claim 1 further comprising:

a leak module configured to selectively diagnose that a leak is present in the refrigeration system based on the total amount of refrigerant; and at least one module configured to take at least one remedial action in response to the diagnosis that the leak is present in the refrigeration system.

9. The refrigerant monitoring system of claim 8 wherein the at least one module includes:

an isolation module configured to, in response to the diagnosis that the leak is present in the refrigeration system of a building, close a first isolation valve located between a condenser located outside of the building and an evaporator located within the building; and a compressor module configured to, in response to the diagnosis that the leak is present in the refrigeration system, operate a compressor of the refrigeration system for a predetermined period.

10. The refrigerant monitoring system of claim 9 wherein the isolation module is further configured to, in response to a determination that compressor has operated for the predetermined period while the first isolation valve is closed, close a second isolation valve located between the evaporator and the compressor of the refrigeration system.

11. The refrigerant monitoring system of claim 10 wherein the first and second isolation valves are located outside of the building.

12. The refrigerant monitoring system of claim 9 wherein the at least one module configured to take at least one remedial action includes an alert module configured to, in response to the diagnosis that the leak is present in the refrigeration system, generate an alert via a visual indicator.

13. The refrigerant monitoring system of claim 9 wherein the at least one module configured to take at least one remedial action includes an alert module configured to, in response to the diagnosis that the leak is present in the refrigeration system, transmit an alert to an external device via a network.

14. The refrigerant monitoring system of claim 8 wherein the leak module is configured to diagnose that a leak is present in the refrigeration system when the total amount of refrigerant is less than a predetermined amount.

15. The refrigerant monitoring system of claim 8 wherein the leak module is configured to diagnose that a leak is present in the refrigeration system when a decrease in the total amount of refrigerant over a predetermined period is greater than a predetermined amount.

16. The refrigerant monitoring system of claim 1 wherein the evaporator charge module is configured to maintain the second amount of refrigerant in an evaporator constant in response to a determination that refrigerant flow through the evaporator is disabled.

17. A refrigerant monitoring method for a refrigeration system, comprising:

by one or more processors, determining a first amount of refrigerant in each condenser of one or more condensers of a refrigeration system;

by the one or more processors, determining a total condenser amount of refrigerant based on the one or more first amounts;

by the one or more processors, determining a second amount of refrigerant in each evaporator of two or more evaporators of the refrigeration system;

by the one or more processors, determining a total evaporator amount of refrigerant based on the two or more second amounts;

by the one or more processors, determining a third amount of refrigerant in each refrigerant line of multiple refrigerant lines of the refrigeration system;

by the one or more processors, determining a total line amount of refrigerant based on the multiple third amounts; and by the one or more processors, determining a total amount of refrigerant in the refrigeration system based on the total condenser amount, the total evaporator amount, and the total line amount, wherein the determining the second amount of refrigerant in each evaporator of two or more evaporators includes, determining the second amount of refrigerant in one of the two or more evaporators based on:

a fourth amount of vapor refrigerant in the one of the two or more evaporators; and a fifth amount of two-phase refrigerant in the one of the two or more evaporators determining the fourth amount of vapor refrigerant in the one of the two or more evaporators based on a first enthalpy of the vapor refrigerant;

determining the fifth amount of two-phase refrigerant in the one of the two or more evaporators based on a second enthalpy of the two-phase refrigerant;

determining a difference between the first and second enthalpies;

determining a first percentage of a total volume of the one of the two or more evaporators including vapor refrigerant based on the difference between the first and second enthalpies;

determining a second percentage of the total volume of the one of the two or more evaporators including vapor refrigerant based on the difference between the first and second enthalpies;

determining the fourth amount based on the first percentage, a first density of vapor refrigerant, and the total volume; and determining the fifth amount based on the first percentage, a second density of two-phase refrigerant, and the total volume.

18. The refrigerant monitoring method of claim 17 wherein determining the total evaporator amount includes setting the total evaporator amount based on a sum of the two or more second amounts.

19. The refrigerant monitoring method of claim 17 wherein determining the total line amount includes setting the total line amount based on a sum of the multiple third amounts.

20. The refrigerant monitoring method of claim 17 further comprising:

selectively diagnosing that a leak is present in the refrigeration system based on the total amount of refrigerant; and taking at least one remedial action in response to the diagnosis that the leak is present in the refrigeration system.

* * * * *